US007478988B2

(12) United States Patent
Porat

(10) Patent No.: US 7,478,988 B2
(45) Date of Patent: Jan. 20, 2009

(54) APPARATUS AND METHOD FOR MANUFACTURING HARD BOOK COVER ASSEMBLIES

(75) Inventor: Thomas Porat, Amherst, NH (US)

(73) Assignee: GP Squared Technologies, Inc., Bow, NH (US)

( * ) Notice: Subject to any disclaimer, the term of this patent is extended or adjusted under 35 U.S.C. 154(b) by 410 days.

(21) Appl. No.: 11/078,860

(22) Filed: Mar. 11, 2005

(65) Prior Publication Data

US 2005/0180843 A1 Aug. 18, 2005

Related U.S. Application Data

(63) Continuation of application No. PCT/US03/28908, filed on Sep. 15, 2003.

(60) Provisional application No. 60/410,841, filed on Sep. 13, 2002.

(51) Int. Cl.
*B42C 11/00* (2006.01)

(52) U.S. Cl. ..... 412/4; 412/3; 412/11; 412/14; 412/16; 412/18

(58) Field of Classification Search ..... 270/58.08, 270/52.22, 58.07, 52.18; 412/1, 3, 9, 11, 412/13, 14, 16, 17, 18, 19, 21
See application file for complete search history.

(56) References Cited

U.S. PATENT DOCUMENTS 2,556,787 A * 6/1951 Bach et al. ..... 156/363
2,769,187 A * 11/1956 D'Huy ..... 412/11
4,111,739 A * 9/1978 De Bin et al. ..... 156/486
4,889,461 A * 12/1989 Kampen et al. ..... 412/19
4,975,010 A * 12/1990 Karolyi ..... 412/3
5,230,687 A 7/1993 Lombardo et al.
5,259,825 A 11/1993 De Angelis et al.
5,364,215 A * 11/1994 Snellman et al. ..... 412/3
5,413,446 A * 5/1995 Rathert et al. ..... 412/17
5,827,033 A * 10/1998 Feldman ..... 412/3
6,193,458 B1 * 2/2001 Marsh ..... 412/1
6,338,603 B1 * 1/2002 Cerruti ..... 412/1
6,352,252 B1 * 3/2002 Schmucker et al. ..... 270/58.07
6,379,094 B1 4/2002 Porat
6,447,230 B1 * 9/2002 Takai et al. ..... 412/14
6,843,473 B2 * 1/2005 Bohn et al. ..... 270/52.18
7,210,887 B2 * 5/2007 Engert et al. ..... 412/33
2006/0210378 A1 * 9/2006 Geldmeier et al. ..... 412/3

FOREIGN PATENT DOCUMENTS

CA 2087657 7/1993
EP 0 461 083 12/1991

OTHER PUBLICATIONS

English language translation of Chinese Office action dated Dec. 7, 2007 cited in Chinese Application 03821663.9, 6 pages.

* cited by examiner

*Primary Examiner*—Dana Ross
*Assistant Examiner*—Jamila Williams
(74) *Attorney, Agent, or Firm*—Grossman Tucker Perreault & Pfleger PLLC

(57) ABSTRACT

An apparatus and a method are provided for making hard book cover assemblies. The apparatus may include a cutter for removing a portion of cover material from a hard book cover assembly. Cutting may be performed without releasing the assembly from a conveyor.

26 Claims, 22 Drawing Sheets

FIG. 1B
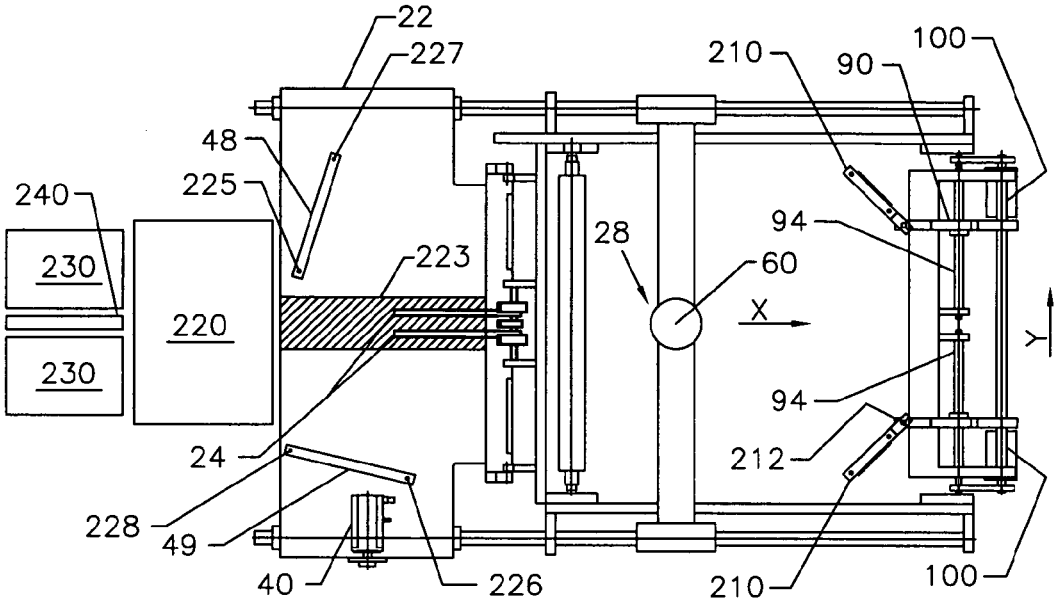
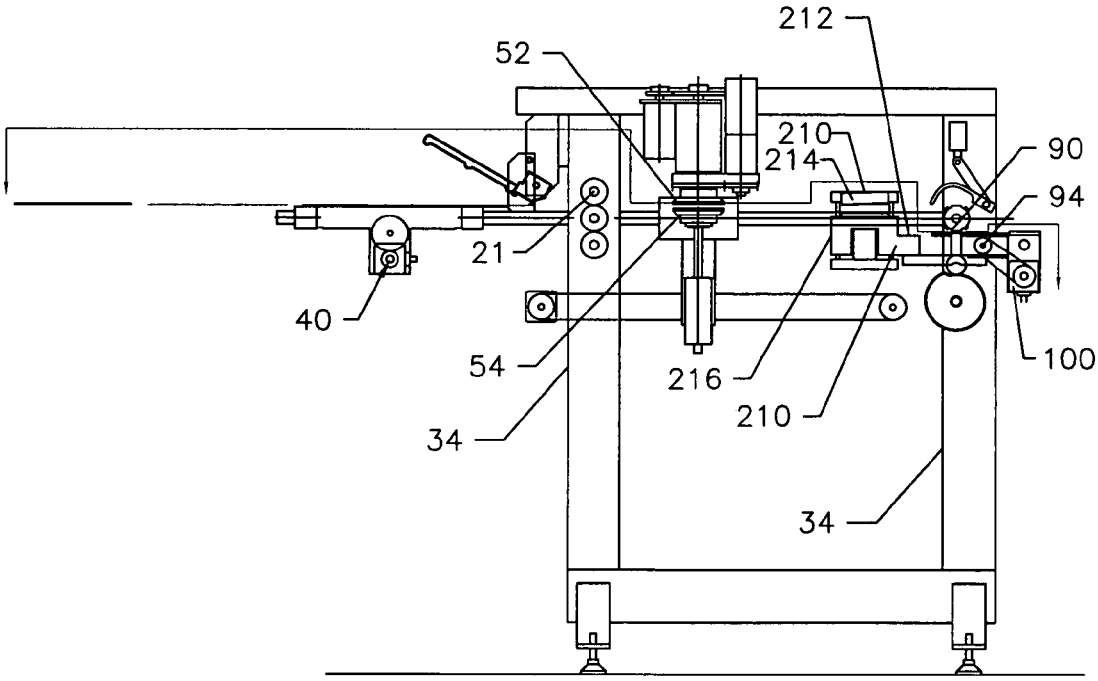
FIG. 1A

FIG. 3B
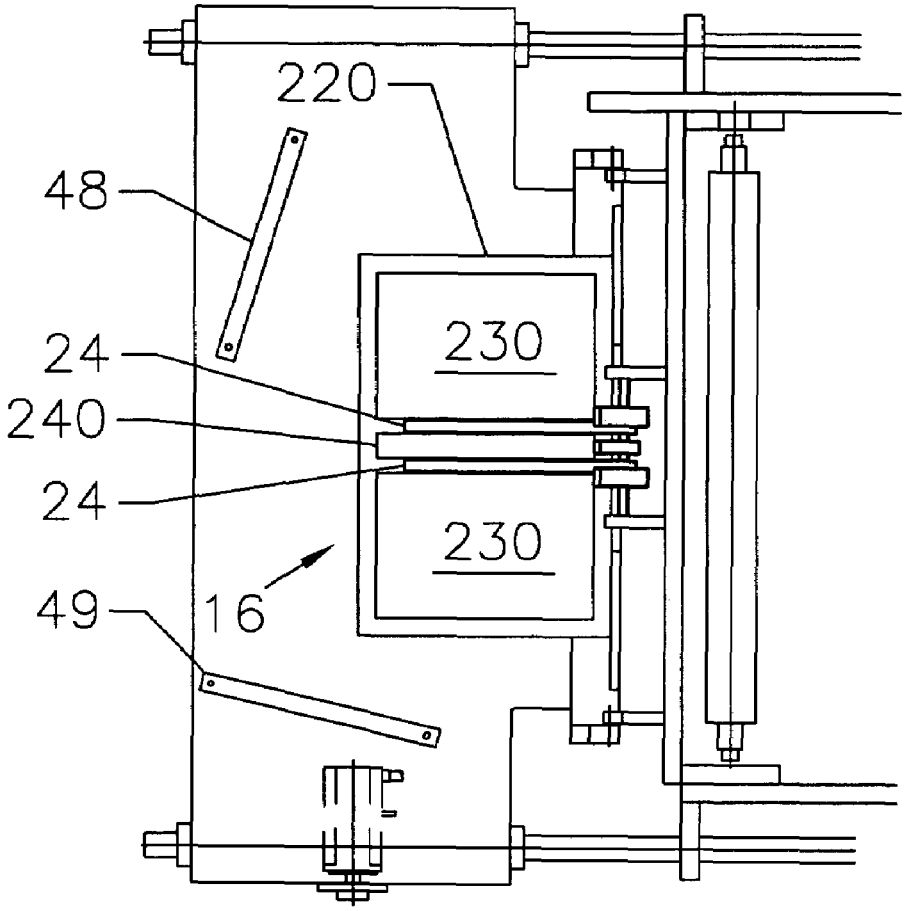
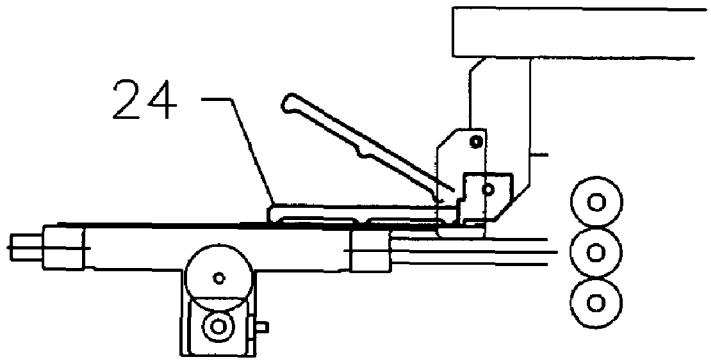
FIG. 3A

FIG. 4B
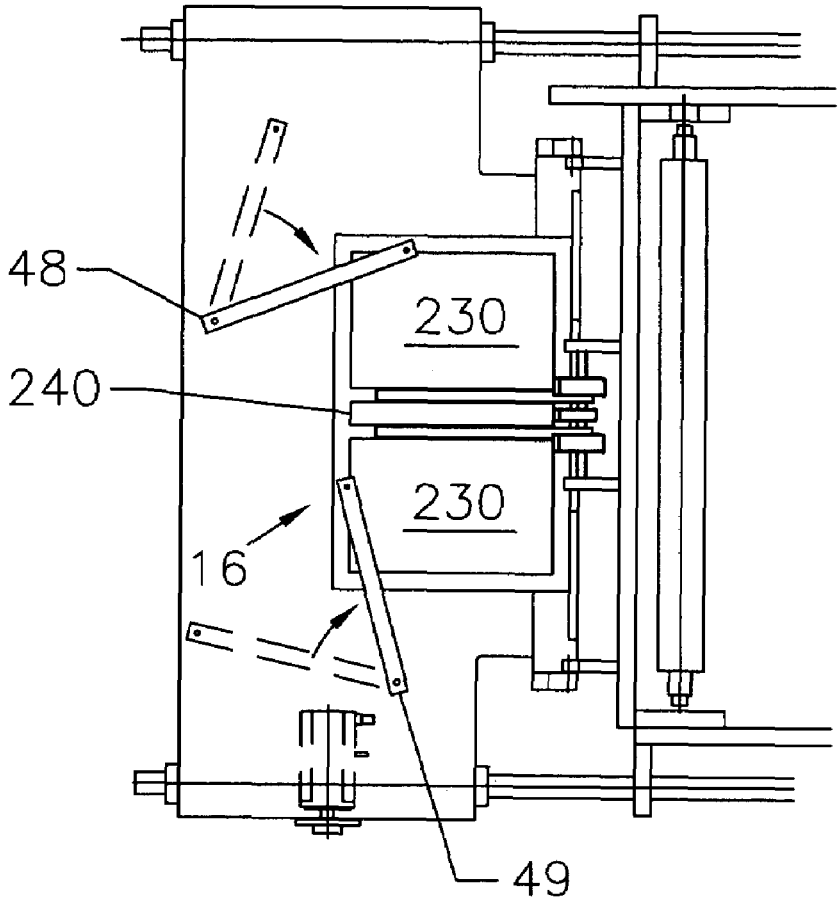
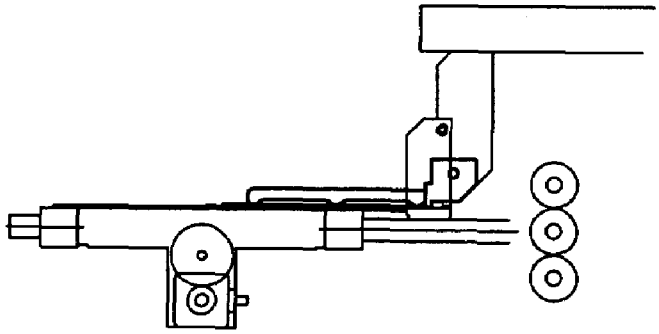
FIG. 4A

FIG. 5B
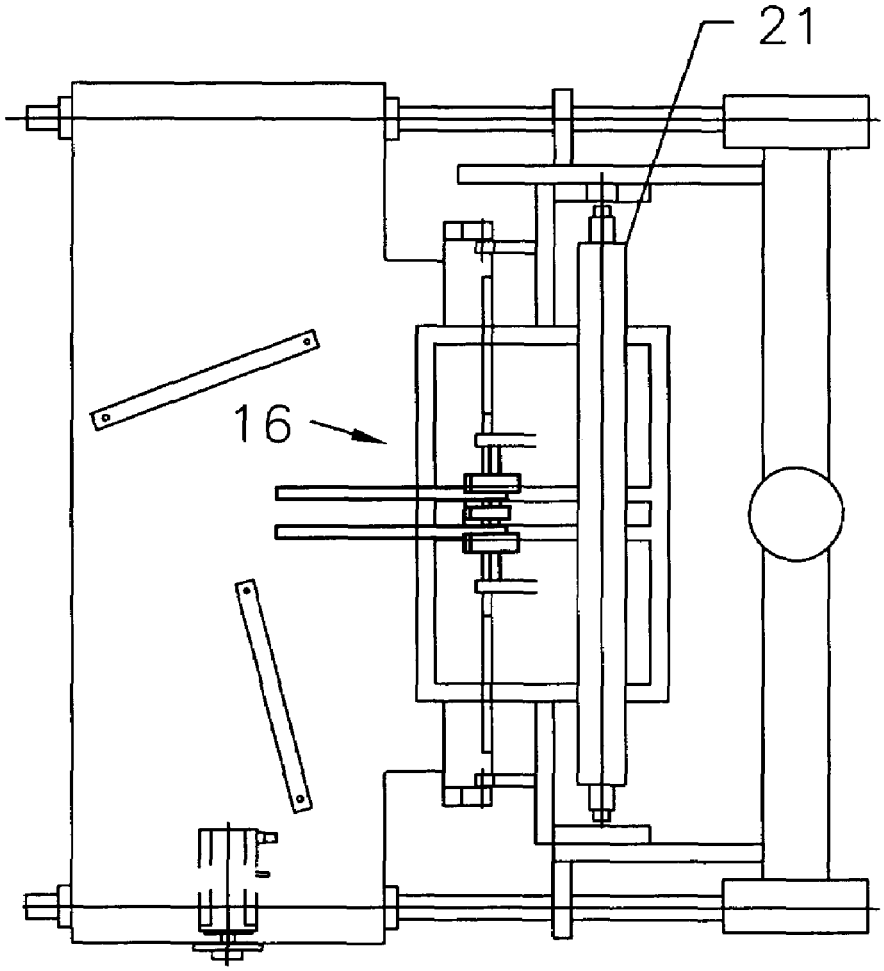
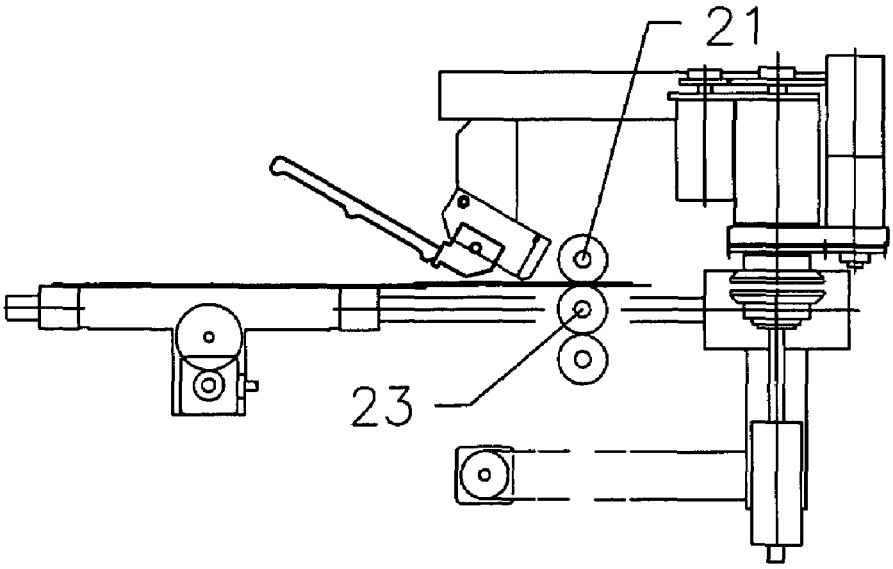
FIG. 5A

FIG. 6B
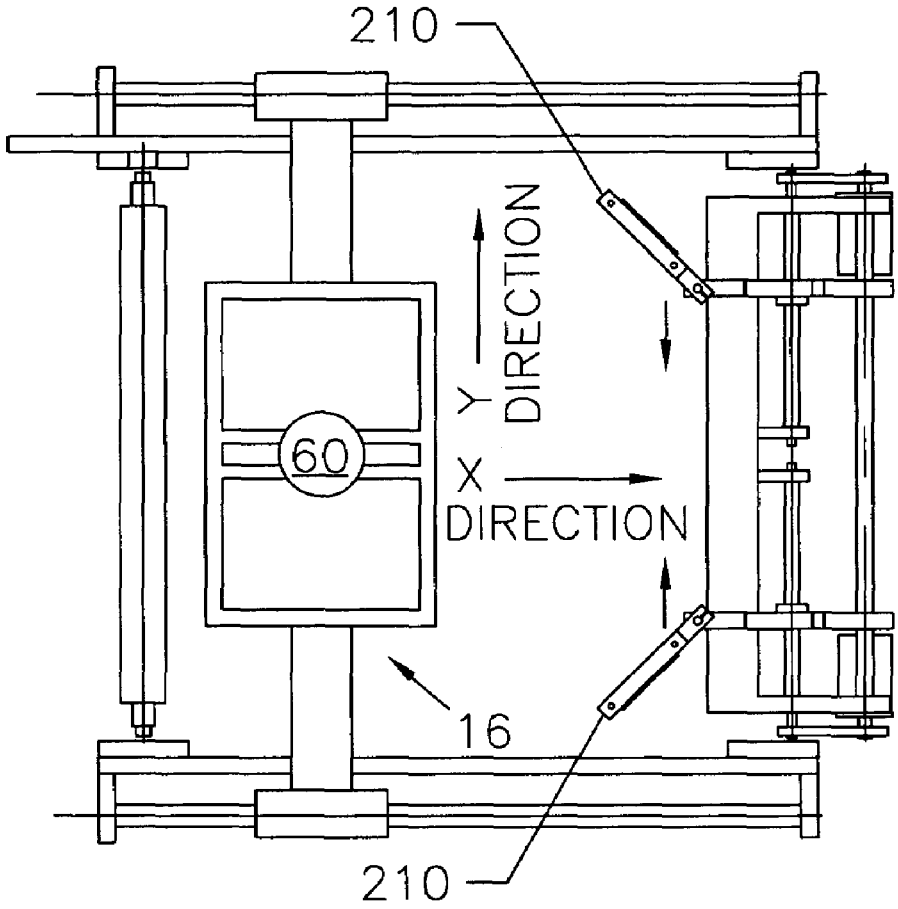
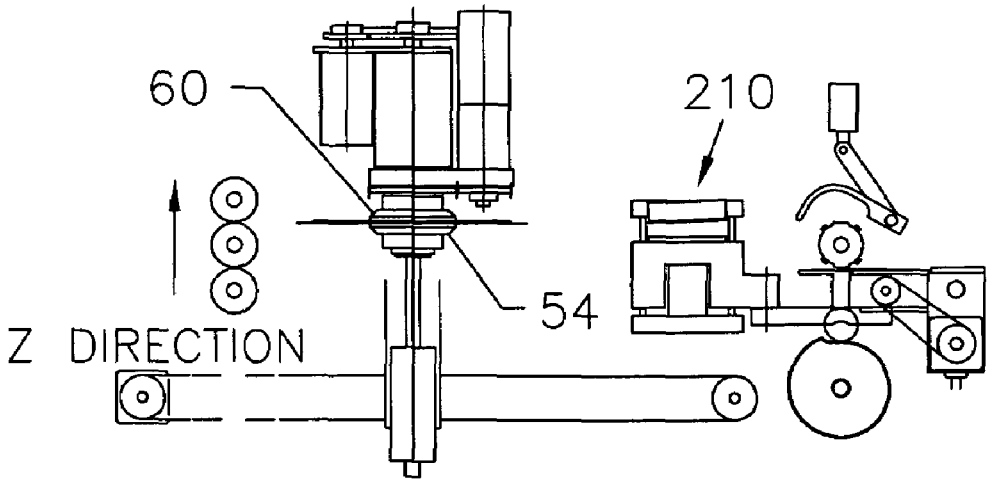
FIG. 6A

FIG. 7B
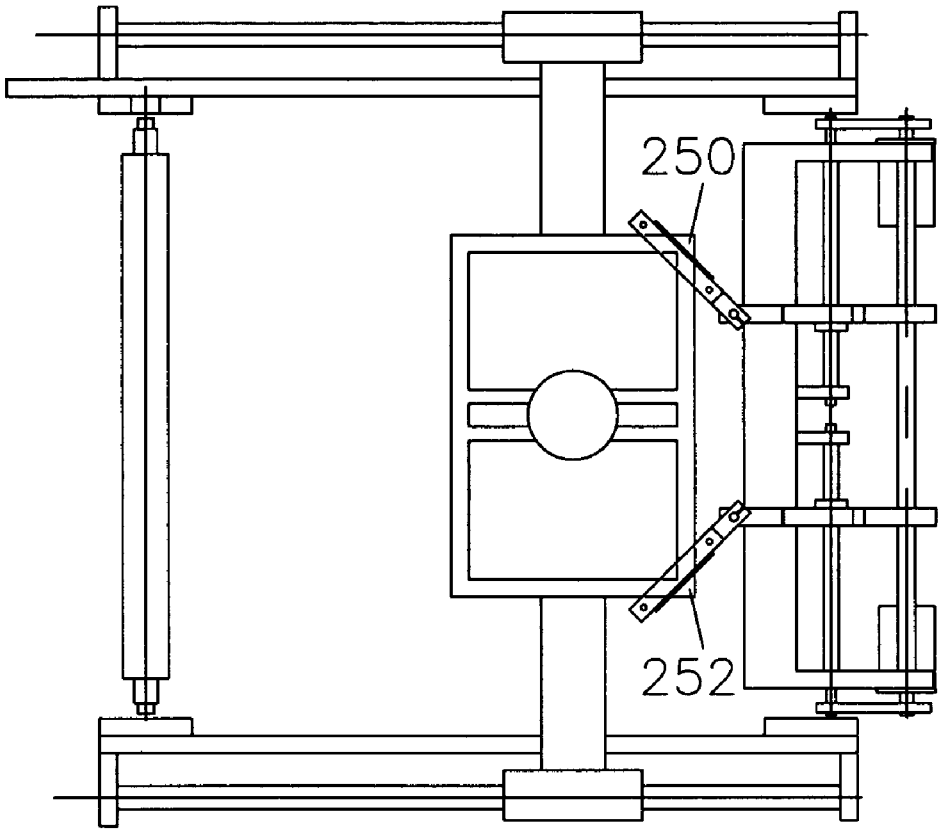
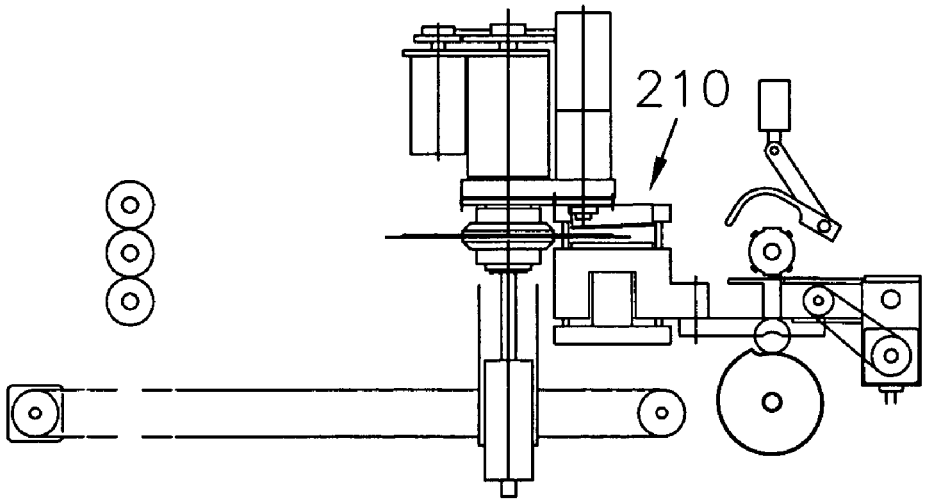
FIG. 7A

FIG. 8B
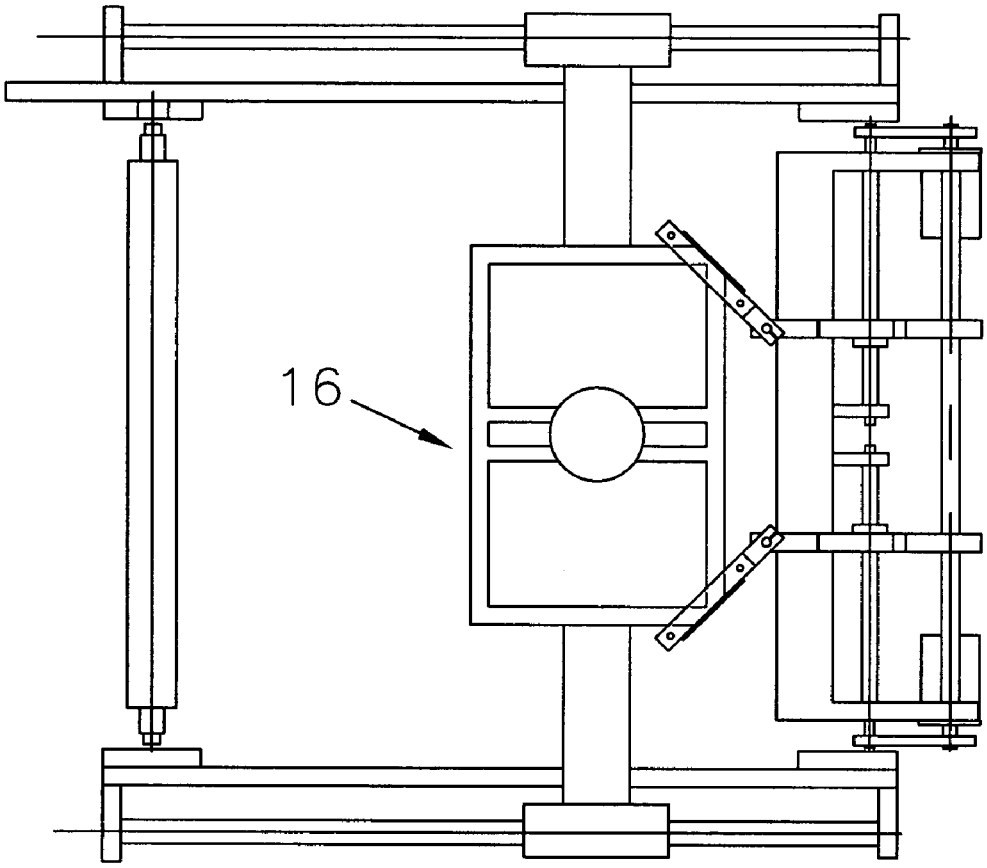
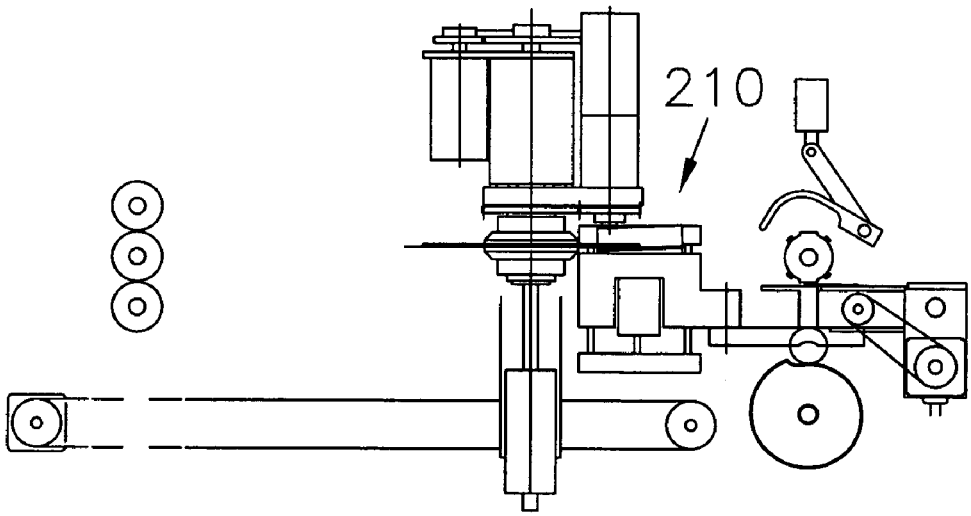
FIG. 8A

FIG. 9B
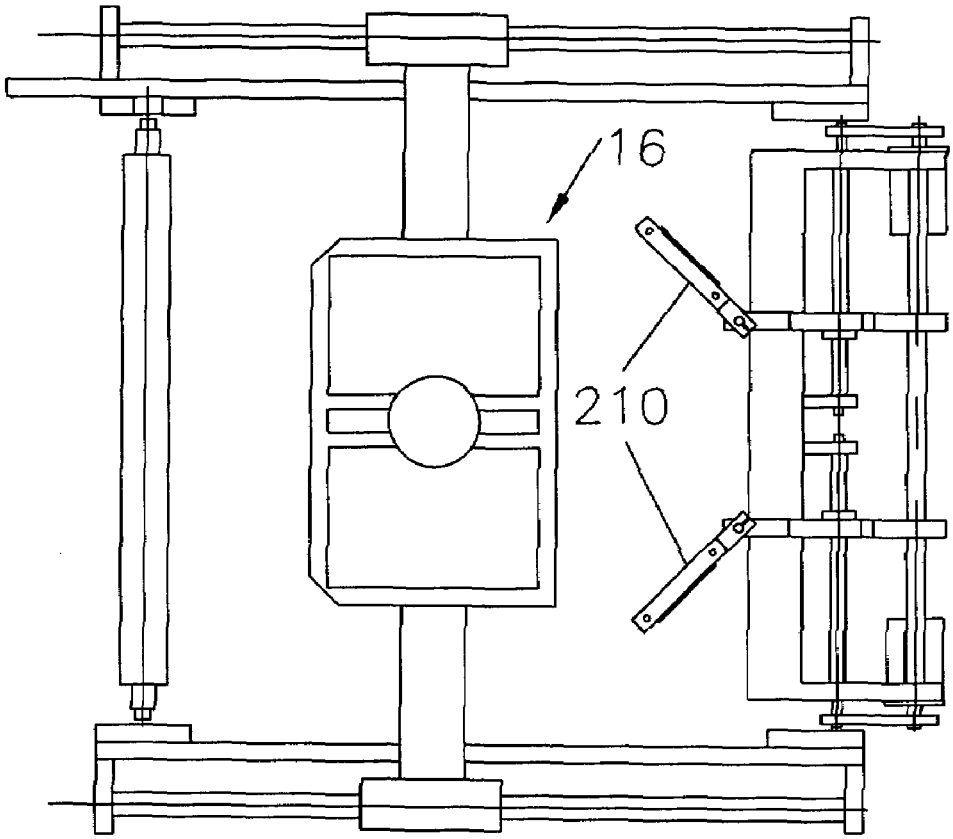
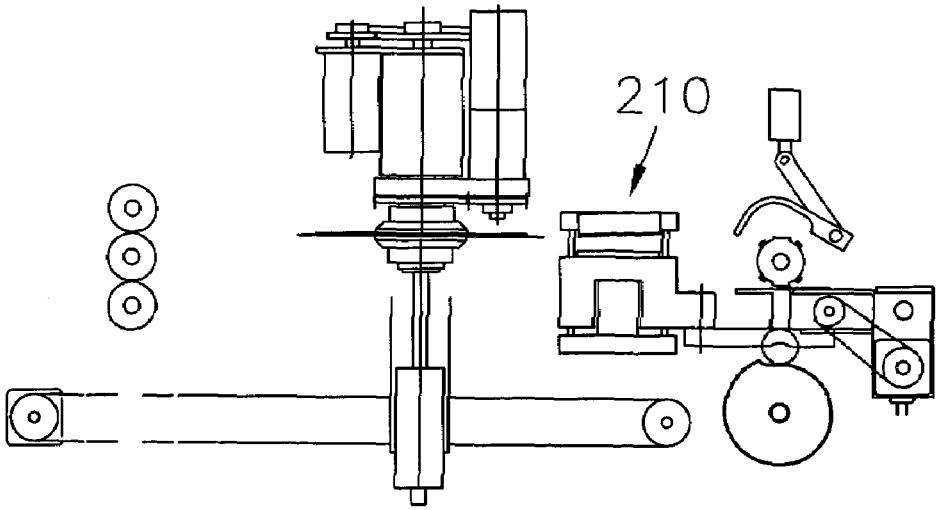
FIG. 9A

FIG. 10B
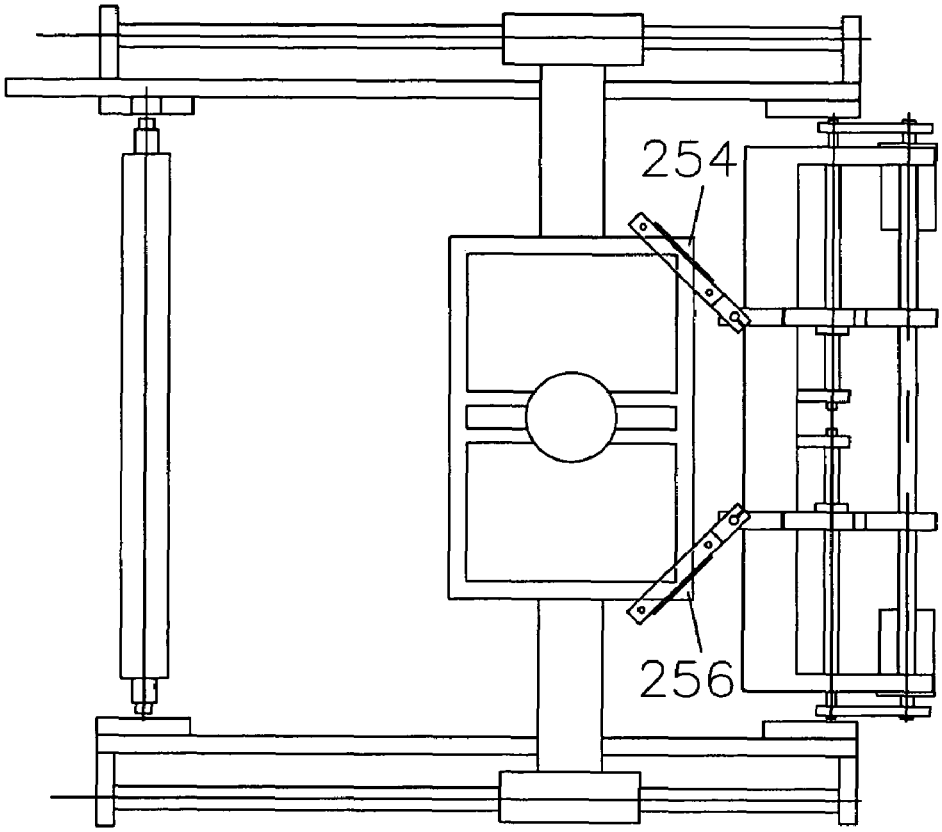
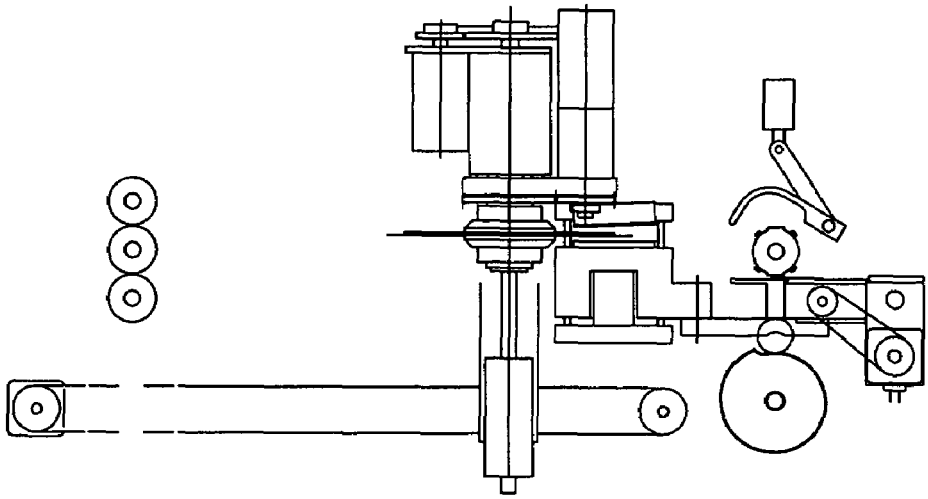
FIG. 10A

FIG. 11B
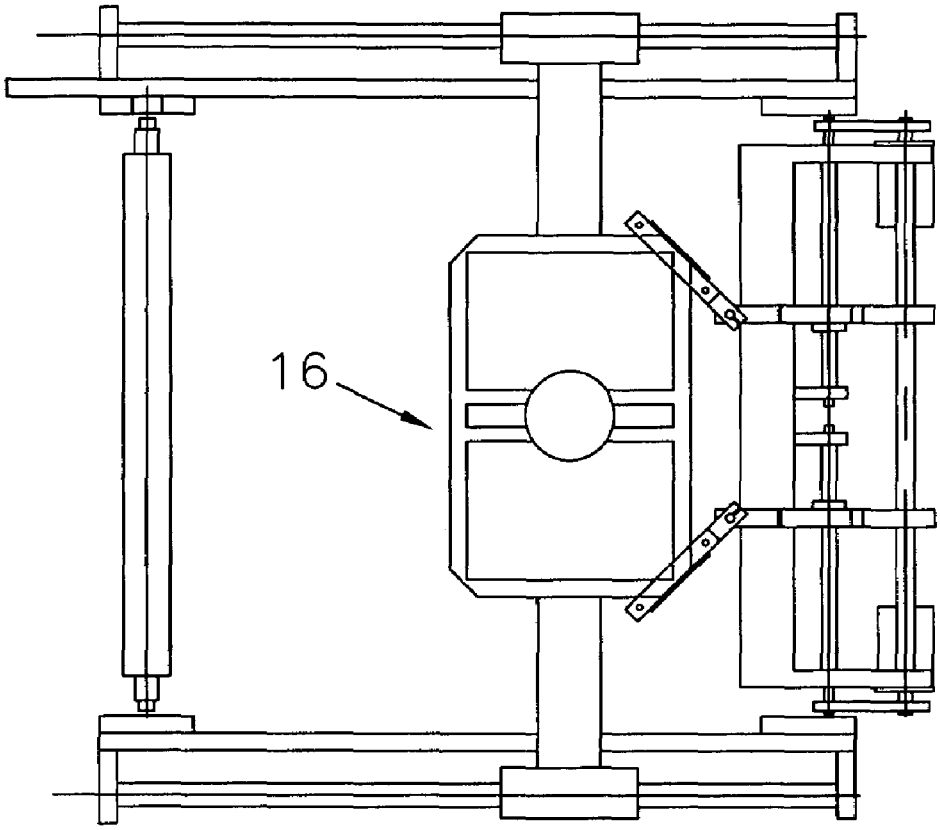
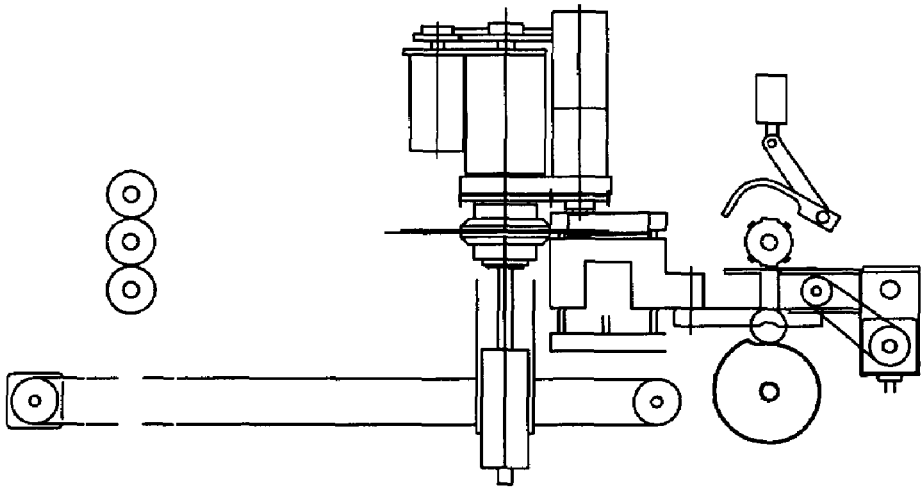
FIG. 11A

FIG. 12B
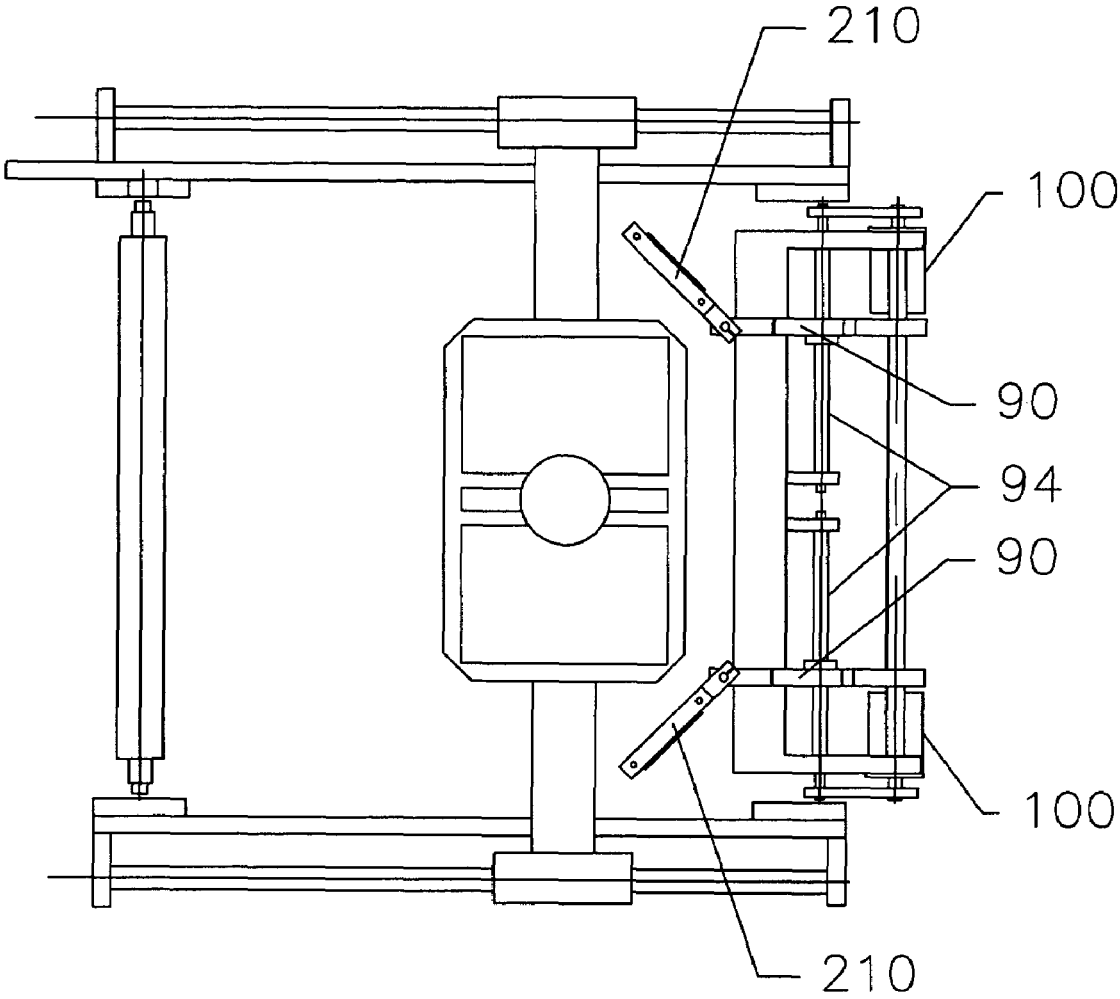
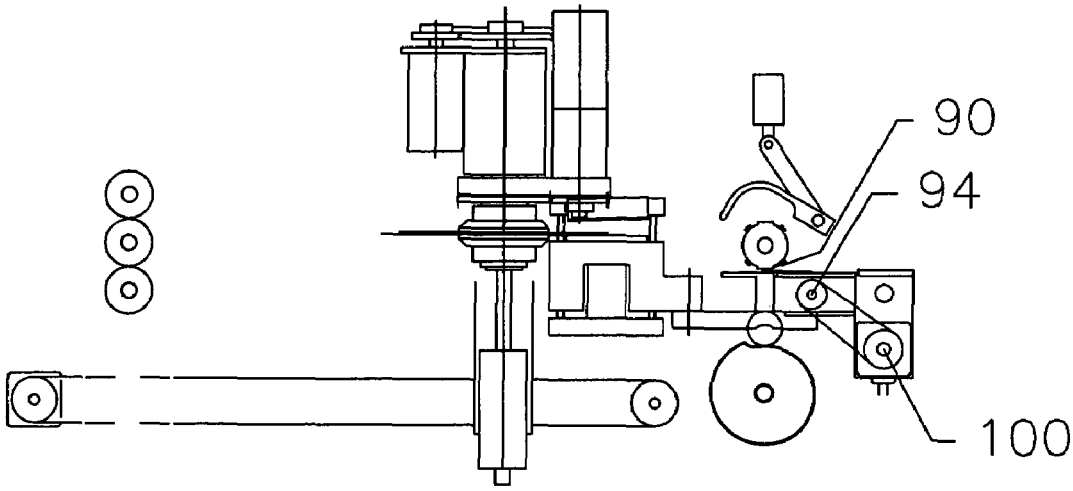
FIG. 12A

FIG. 13B
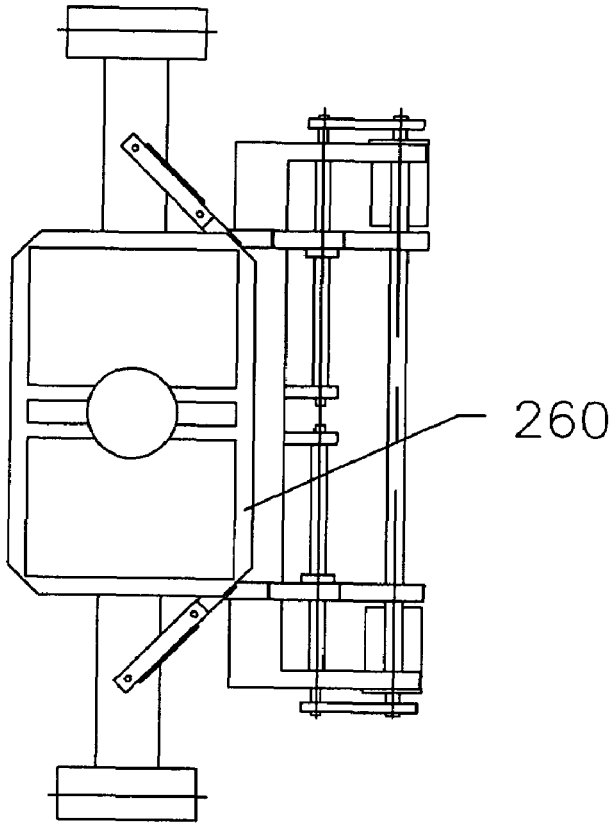
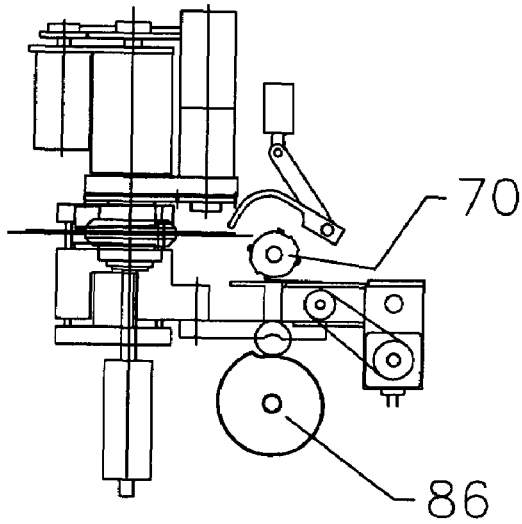
FIG. 13A

FIG. 14B
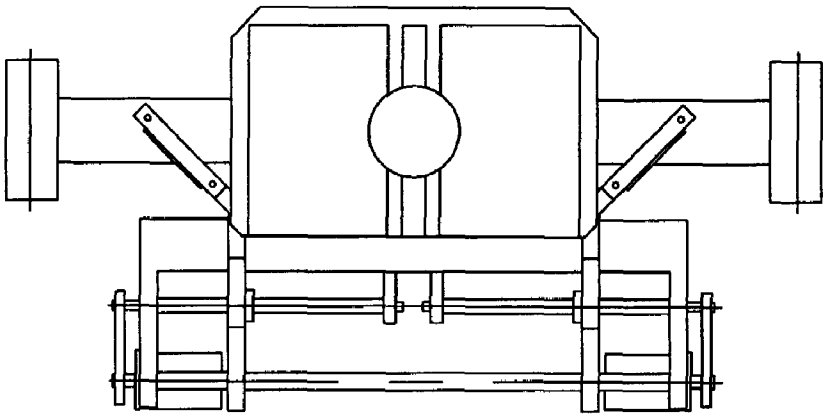
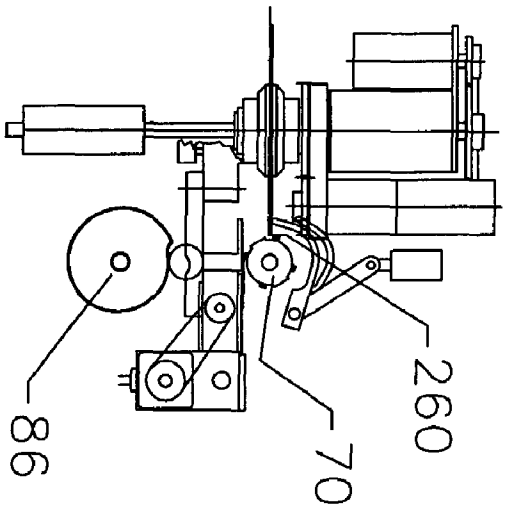
FIG. 14A

FIG. 15B
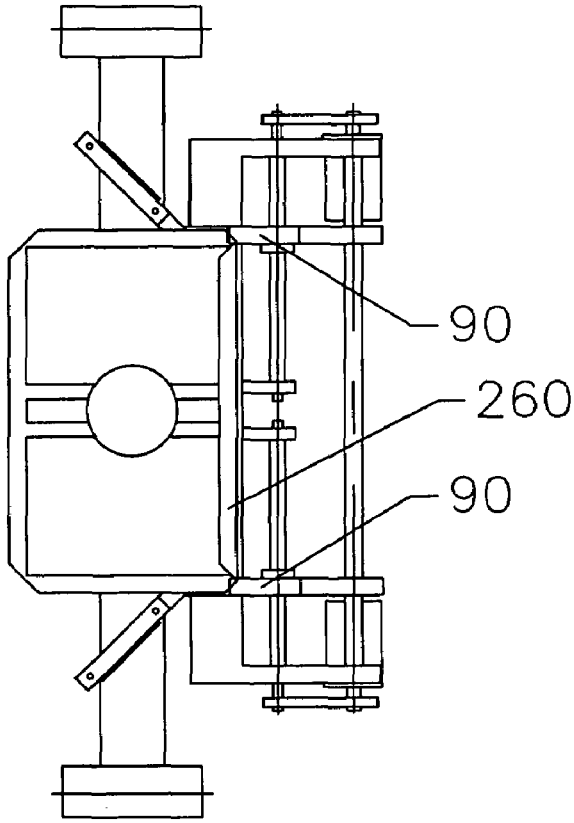
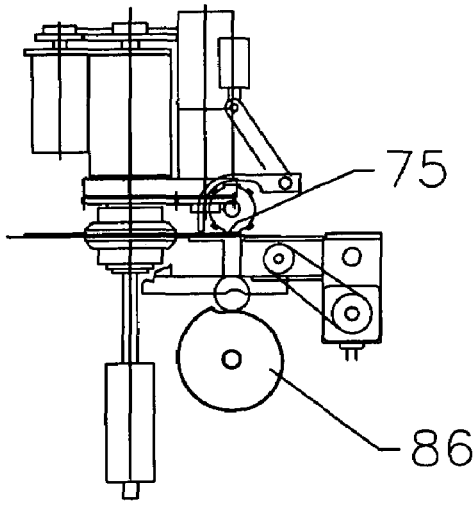
FIG. 15A

FIG. 16B
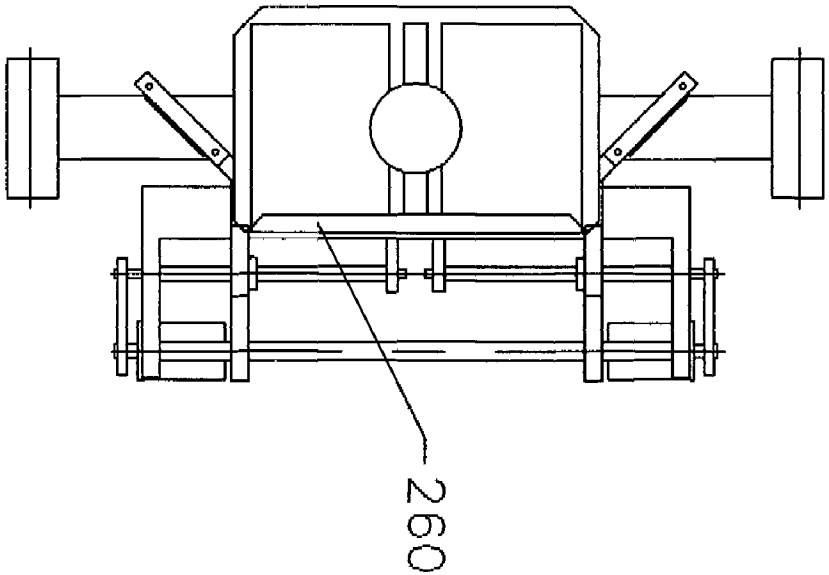
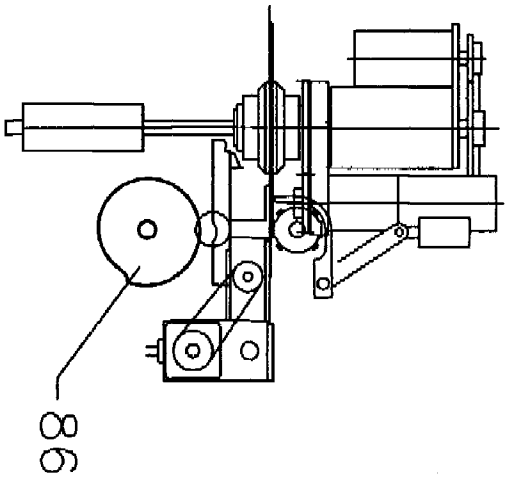
FIG. 16A

APPARATUS AND METHOD FOR MANUFACTURING HARD BOOK COVER ASSEMBLIES

RELATED APPLICATIONS

This application is a continuation of PCT Application No. PCT/US2003/028908, filed on Sep. 15, 2003, published as WO 2004/024461A1 on Mar. 25, 2004, and claims benefit of U.S. Provisional Application No. 60/410,841, filed on Sep. 13, 2002. Both of these applications are incorporated by reference herein.

FIELD OF INVENTION

This application relates to a method and apparatus for producing hard book cover assemblies and is in particular directed to a method and apparatus for cutting the corners off of hard book cover assemblies.

BACKGROUND

Cases for hard cover books are typically produced by printing a rectangular sheet of paper, cloth or leather, known as the cover material, and subsequently gluing the cover material to a pair of panels and a spine. The panels and spine (the rigid component) provide rigidity for the case, with one of the panels forming the front of the finished book and the second forming the back. The spine provides rigidity to the spine portion of the book. The spine and panels are typically made of chipboard or other stiff material. A space is usually left between the spine and the panels so that the cover may be opened and closed in hinge-like fashion. Manufacturing techniques typically include a step of placing the panels and spine on a glued cover material and then folding the edges of the cover material up and onto the inside edges of the panels (and the ends of the spine). Together, the spine, panels, and cover material are known as a hard book cover assembly.

In an unfinished hard book cover assembly, the cover material is sized and placed to extend outwardly past the periphery of the spine and the panels to be later folded back over the edges of the spine and panels to produce an attractive cover. The overlapping edges of the cover material are glued on the inside of the panels and spine, and these edges are generally hidden later in the book making process when paper or other material is glued over the interior of the hard book cover in a manner that overlaps, and thus hides, the edge of the cover material from a reader. Typically, only a few millimeters of cover material are visible around the inside edges when a hard cover book is completed. One of the steps involved in producing a cover for hard cover books is the folding of the corners of the extended cover material over the corners of the panels. Procedures for fabricating a hard cover book are described below and in co-owned U.S Pat. No. 6,379,094 (the '094 patent) which is hereby incorporated by reference in its entirety herein.

There are two main types of corner folding used to make hard cover books. One type of corner fold is known as an "edition corner" (also cut corner, standard corner, tucked corner or square corner). The second type is known as a "library corner."

For edition corners, the cover material is typically cut into a rectangular shape that is about 1½ inches larger in each of the X and Y dimension than the desired finished (open and flat) book cover (case) size. When the cover material is affixed to the rigid components of the hard book cover assembly (for example, 2 panels and 1 spine) there typically is a cover material overhang of about ¾ inch around the outer edges of the rigid components. To remove excess cover material, the corners of the cover material typically are trimmed prior to affixing the cover material to the panels and spine. By eliminating this corner material, multiple layers of bunched cover material do not develop at the corners of the finished hard book cover assembly.

Cover material is often cut in a stack so that multiple pieces can be cut simultaneously in preparation for a run of many copies of the same hard book cover assembly. This is typically performed at a cutting station separate from the hard book cover assembly apparatus.

An identically sized triangular piece is cut from each of the four corners as the spine and panel will be placed square and centered on the cover material. Preferably, these cuts are made at a 45 degree angle to the longitudinal edges of the panels leaving an amount of cover material extending outwardly from each of the outer two corners (in a direction bisecting the 90 degree corner of the panel) of each panel a distance that will be equivalent to approximately 2 times the thickness of the panel material in the finished product. By knowing what the final size of the finished hard book cover assembly will be and by placing the rigid component squarely centered on the cover material, all four corners of the cover material can be cut equally to arrive at approximately the desired overhang. Often, however, slight variations in placement of the spine or panels can result in a corner overhang that is not equal to the desired 2 times panel thickness.

After the corners have been cut and an adhesive has been applied to the cover material, the spine and panels are placed on the cover material with the outer edges of the panels in parallel with the adjacent (closest) outer edges of the cover material. Each edge can be longitudinally folded over the panel to produce an edition corner that has only a small area of glued, overlapping cover material on the inside surface of each panel at the corner.

For a library corner, the corner of the cover material is not cut off, but is instead folded back over the corner of the panel prior to folding back the longitudinal edges of the cover material. This results in an extra layer of cover material on the inside of the panel.

Due to the ease with which books and manuscripts can be printed using modem technologies, such as digital printing, a need has developed for hard cover book making machines that can produce small numbers (tens or hundreds, for example) of hard covers for authors and publishers desiring hard covers for their works. Furthermore, as digital printing becomes available in numerous outlets, including copy shops, work places, and even homes, there has developed a need for hard cover book making machines that can be operated in these areas. In addition to being inexpensive, it may be desired that the book cover making machines require as small an amount of space as possible, are easy to set up, and require minimal skill and training for operation. Space considerations may be of particular interest in those locations with higher real estate expense than traditional publishing companies.

In hard book cover making operations, it is desirable that a sheet of printed cover material be printed and cut accurately and with precision from one sheet to the next. In reality, this is not always the case, and often the printing may be out of registration, skewed or otherwise imperfect. Rectangular cover material is traditionally printed so that it can be centered in relation to the spine and panels, with a consistent amount of cover material overhang with respect to opposing edges. Often, the center of the cover material sheet is notched in the center at the top and/or bottom so that it can be easily aligned with the spine. If the printing on the cover material is not centered, or is not square, centering of the cover material in relation to the spine can result in a finished hard book cover assembly that is imperfect and may have to be discarded. For example, the title may not be aligned with the center of the spine on a finished book, or a photograph, border, or other artwork may extend inside the cover when originally designed to be displayed accurately on the outer portion of the cover. Such inaccuracies may not be discovered until after a number of imperfect cover assemblies are produced. This can result in, for example, added costs, significant downtime, or waste.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 1A is a diagrammatic elevational view of the apparatus for manufacturing a hard book cover according to the present invention;

FIG. 1B is a diagrammatic top plan sectional view along section line in FIG. 1*a;*

FIG. 3A is a diagrammatic cross-sectional partial view of the cover material and the rigid components placed on the infeed table;

FIG. 3B is a diagrammatic top plan partial view showing the cover material and the rigid components placed on the infeed table;

FIG. 4A is a diagrammatic cross-sectional partial view of the cover material and the rigid components placed on the infeed table;

FIG. 4B is a diagrammatic top plan partial view showing the cover material and the rigid components placed on the infeed table and the sizing arms rotated into position to measure the rigid components;

FIG. 5A is a diagrammatic cross-sectional partial view of the hard book cover assembly partially fed through the compression rollers;

FIG. 5B is a diagrammatic top plan partial view showing the hard book cover assembly partially fed through the compression rollers;

FIG. 6A is a diagrammatic cross-sectional partial view of the hard book cover assembly held by the platen assembly;

FIG. 6B is a diagrammatic top plan partial view of the hard book cover assembly held by the platen assembly;

FIG. 7A is a diagrammatic cross-sectional partial view of the hard book cover assembly held by the platen assembly in a position where the corners of the cover material are between the upper knife blade and the shear plate;

FIG. 7B is a diagrammatic top plan partial view of the hard book cover assembly held by the platen assembly in a position where the corners of the cover material are between the upper knife blade and the shear plate;

FIG. 8A is a diagrammatic cross-sectional partial view of the hard book cover assembly with (2) corners cut from the cover material.

FIG. 8B is a diagrammatic top plan partial view of the hard book cover assembly with (2) corners cut from the cover material.

FIG. 9A is a diagrammatic cross-sectional partial view of the hard book cover assembly, with (2) corners cut from the cover material, moved away from the cutters and rotated 180 degrees.

FIG. 9B is a diagrammatic top plan partial view of the hard book cover assembly with, with (2) corners cut from the cover material, moved away from the cutters and rotated 180 degrees.

FIG. 10A is a diagrammatic cross-sectional partial view of the hard book cover assembly positioned to cut remaining corners;

FIG. 10B is a diagrammatic top plan partial view of the hard book cover assembly positioned to cut remaining corners;

FIG. 11A is a diagrammatic cross-sectional partial view of the hard book cover assembly with (4) corners cut from the cover material;

FIG. 11B is a diagrammatic top plan partial view of the hard book cover assembly with (4) corners cut from the cover material;

FIG. 12A is a diagrammatic cross-sectional partial view of the hard book cover assembly remaining stationary while the cutters (and tucking devices) move outward from the cutting position to the tucking position;

FIG. 12B is a diagrammatic top plan partial view of the hard book cover assembly remaining stationary while the cutters (and tucking devices) move outward from the cutting position to the tucking position;

FIG. 13A is a diagrammatic cross-sectional partial view of the hard book cover assembly moved close to the brush bar prior to the first fold and tucking operation;

FIG. 13B is a diagrammatic top plan partial view of the hard book cover assembly moved close to the brush bar prior to the first fold and tucking operation;

FIG. 14A is a diagrammatic cross-sectional partial view of the hard book cover assembly moving downward, while rotation of the brush bar pushes the edge of the cover material upward, to begin the fold;

FIG. 14B is a diagrammatic top plan partial view of the hard book cover assembly with the leading edge partially folded. The brush bar has been removed for clarity;

FIG. 15A is a diagrammatic cross-sectional partial view showing the leading edge of the hard book cover assembly folded back onto the rigid components;

FIG. 15B is a diagrammatic top plan partial view of the hard book cover assembly (brush bar removed) with the leading edge folded and (2) corners being tucked by the tuck fingers;

FIG. 16A is a diagrammatic cross-sectional partial view showing the leading edge of the hard book cover assembly folded back onto the rigid components and being pressed by the lower clamp;

FIG. 16B is a diagrammatic top plan partial view of the hard book cover assembly (brush bar removed) with the leading edge folded and (2) corners being tucked by the tuck fingers;

SUMMARY

Figure 2B:
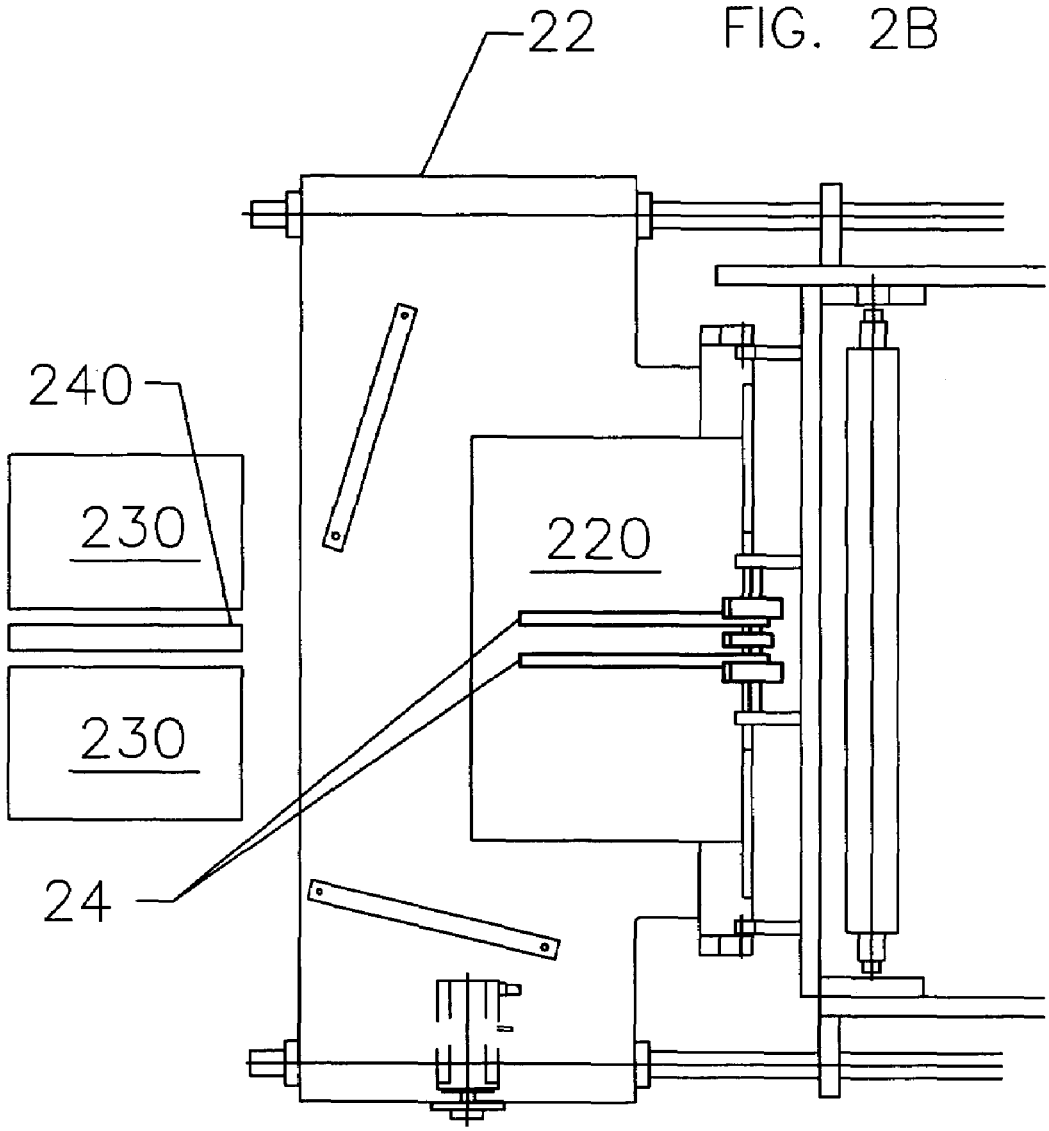
FIG. 2B is a diagrammatic top plan partial view showing the cover material on the infeed table.

In one aspect, an apparatus is provided, the apparatus comprising a framework, a sizing device associated with the framework, the sizing device constructed and arranged to determine the size of at least a portion of a rigid component of an unfinished hard book cover assembly; a folding mechanism associated with the framework, the folding mechanism constructed and arranged to fold back a portion of cover material onto the rigid component of the unfinished hard book cover assembly; and at least one cutter associated with the framework, the at least one cutter constructed and arranged to cut at least one corner from the cover material.

In another aspect, a method is provided for producing a hard book cover assembly, the method comprising providing an unfinished hard book cover assembly; determining a dimension of the rigid component of the unfinished hard book cover assembly; transmitting the dimension to a controller; and cutting a first portion off of the cover material at a cutting location that is a function of the dimension transmitted to the controller.

In another aspect, a method of making a hard book cover assembly is provided, the method comprising (a) providing an unfinished hard book cover assembly including a cover material and a rigid component; (b) securing the unfinished hard book cover assembly in a conveyor (c) cutting at least one corner from the cover material; (d) folding at least one edge of the cover material onto the rigid portion; and (e) adhering the edge of the cover material to the rigid portion, wherein steps (c), (d) and (e) are performed without releasing the unfinished hard book cover assembly from the conveyor.

In another aspect, an apparatus for making a hard book cover assembly is provided, the apparatus comprising a framework; a conveyor associated with the framework, the conveyor constructed and arranged to secure and transport an unfinished hard book cover assembly comprising a cover material, a rigid component and an adhesive; and at least one and fewer than four cutters associated with the framework and constructed and arranged to cut at least one corner from the cover material of the unfinished hard book cover assembly.

In another aspect, a method of making a hard book cover assembly is provided, the method comprising (a) providing an unfinished hard book cover assembly including a cover material and a rigid component joined by an adhesive; (b) securing the unfinished hard book cover assembly by a rotatable platen (c) cutting a first corner from the unfinished hard book cover assembly while secured by the platen; (d) rotating the unfinished hard book cover assembly while secured by the platen; (e) cutting a second corner from the unfinished hard book cover assembly while secured by the platen; and (f) folding a portion of the cover material extending between the first and second corners onto the rigid component to produce a hard book cover assembly.

In another aspect, a method of making a hard book cover assembly is provided, the method comprising (a) providing a cover material having four edges; (b) positioning at least one panel on the cover material so that an edge of the panel is not parallel to an edge of the cover material; (c) cutting at least two unequal corner pieces from the cover material to provide a cover material with at least two cut corners; and (d) folding onto the panel a portion of the cover material that extends between the two cut corners to produce a hard book cover assembly.

In another aspect, a method of making a hard book cover assembly is provided, the method comprising providing a hard book cover assembly; rotating the hard book cover assembly about an axis of rotation; and cutting at least one corner from a cover material while the hard book cover assembly is rotating.

In another aspect, an apparatus for making a hard book cover assembly is provided, the apparatus comprising a support means; a sizing means associated with the support means, the sizing means for determining a dimension of an unfinished hard book cover assembly; a conveying means associated with the support means, the conveying means for transporting the unfinished hard book cover assembly; and a cutting means associated with the support means, the cutting means for cutting at least one corner from the unfinished hard book cover assembly.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

DETAILED DESCRIPTION

A hard book cover assembly includes cover material, a rigid component and an adhesive joining the cover material to the rigid component. The rigid component is typically a spine and two panels although in some applications the spine may be eliminated and in some, a single panel can be used. The adhesive may be a separate substance or may be contained in or on the rigid component and/or the cover material and serves to join the cover material to the rigid component. As used herein, hard book cover assemblies include book covers (cases) as well as menu covers, calendars, game boards, loose leaf binders and other products apparent to those skilled in the art that can be manufactured by affixing cover material to a rigid component.

As described in co-owned U.S. Pat. No. 6,379,094 (the '094 patent) which is incorporated by reference herein, a book cover for a hard cover book can be produced by placing a spine and two opposing panels on a piece of glued cover material and folding the material over the rigid pieces. A space between the spine and each of the panels forms hinges that allow for pivoting of the hard cover around these hinges, allowing the book cover to be easily opened and closed. In operation, the cover material is typically a textured or coated paper, synthetic, cloth, or leather, that has been printed with any desired information, for example, a title, author, and possibly a drawing or photograph. The cover material is placed in contact with a pair of panels and a spine. The panels and spine can be made of any suitable material, such as chipboard. Provided with the teachings disclosed herein, it will be readily apparent to one skilled in the art how these teachings can be used in conjunction with the disclosure of the '094 patent.

As part of an apparatus, a cutter or cutters may be associated with other components of the apparatus. The cutter or cutters may be associated with a framework that may also be associated with other components. Two items or components are associated with each other if there is a structural interdependent interrelationship between the two. Two items may be associated with each other if they are, for example, fastened, supported, fixed, resting, hinged, integral, in contact, connected or removably connected with or to each other. Two items may also be associated with each other if they are each associated with a third item.

In one aspect, the invention provides an apparatus for making a hard book cover assembly, the apparatus including one or more cutters. The cutter may be used to remove corners from cover material after the rigid component has been affixed to the cover material. For example, to facilitate the formation of an edition corner or corners, the cutter may be used to cut off one or more corner portions of the cover material. The cutter may be attached to a framework and configured and arranged to cut corners at any desirable angle in relation to the edge of the panel, for example, 45 degrees. The cutter may cut a straight cut or a shaped cut or to cut multiple angles along the cutting line. Examples of a cutter include, but are not limited to, a knife blade, a laser, a water jet, a saw, a hot wire, scissors and a stamp. The cutter may be powered and/or activated in any number of ways, including, but not exclusively, pneumatically, mechanically, hydraulically, magnetically or electrically.

In one embodiment, the apparatus cuts the cover material without transferring the unfinished book cover assembly to a different station before, or after, other operations such as folding or tucking. The apparatus may include a conveyor that continuously supports the book cover assembly during cutting as well as during one or more additional processes such as folding and tucking. The apparatus may securely hold the book cover assembly through multiple operations, including cutting, without releasing the book cover assembly for additional operations after or before cutting. Additional operations may include, for example, tucking, folding and/or pressing. Thus, an unfinished hard book cover assembly can be secured in a conveyor and be cut and/or tucked and/or folded without handing off the assembly to different stations. In one embodiment, the apparatus also includes a controller that directs the positioning of the conveyor in any one or more of the x, y and z planes. As the conveyor need not release the assembly until the assembly is finished, the precise location of the book cover assembly can be known at any time during the manufacturing process.

In one embodiment, a conveyor is a rotatable platen including an upper platen assembly and a lower platen assembly. This conveyor may provide for precision that is unobtainable when an unfinished assembly is handed off to one or more stations as any shifts in position that may result from a hand off process can be avoided. This maintenance of precision can provide for an improved book cover as cuts may be more precise, resulting in preferred cover material overhang at the panel corners.

The apparatus need not move the cover material to a separate location to cut the corners. Prior to cutting, the cover material may be placed in contact with a panel and a spine, thus forming an unfinished hard book cover assembly. The cutter may be positioned so that a conveyor supporting the hard book cover assembly can provide the cutter with access to one or more corners of the book cover assembly without moving the book cover assembly to another location. In one embodiment, this may be done by supporting the hard book cover assembly from the top and bottom using a linearly movable and/or rotatable platen (platen), as described in the '094 patent. The cutter may be constructed and arranged to work in conjunction with the platen assembly. To align the cutter with a corner of the book cover assembly, the cutter may be moved, the conveyor may be moved, or both may be moved. In one embodiment, the cutter is movable laterally and the conveyor longitudinally and vertically. However, any suitable arrangement may be employed to properly position the cutter and book cover assembly relative to each other. The action and the positioning of the cutter may be automated, for example, using computer control. In one embodiment, this control may facilitate coordination between the cutter and other components of the apparatus.

In another aspect, the apparatus for making hard book covers may be configured to operate in a small area. This may be of particular interest to producers of lower numbers of hard book covers or hard cover books. A number of manufacturing procedures may be performed in a limited space. In one embodiment, the apparatus may include any combination of a compression roller, a conveyor, a cutter, a tucker and a folder. For example, the apparatus may include a cutter and be operable in less than 200, less than 100, or less than 50 square feet of space. A conveyor, a compression roller, an infeed table, a tucker and a folder may be added in any combination without increasing the area required to operate. The apparatus may compress, cut, tuck and fold (or any combination of these) an entire hard book cover assembly before starting on a second hard book cover assembly. For instance, a first hard book cover assembly may be released by a conveyor before a second hard book cover assembly is secured by the conveyor.

In one embodiment, the invention provides for a hard book cover making apparatus including an infeed table, a compression roller, a conveyor, a cutter, a tucker and a folder that can fit on a framework that requires less than about 50 square feet of floor space. Of course, individual components may be added or deleted as desired to carry out various processes or combinations of processes. This configuration may allow for the installation of such a machine in spaces where installation of larger machines, e.g., those requiring at least 100, 200, 300 or more square feet, is either not practical or not possible.

In one embodiment, the apparatus performs the operations (which may be automated) of registering and combining the cover material with the spine and panels, cutting the corners of the cover material, and folding the edges of the cover material over the edges of the panels and spine in less than 100, 50 or 30 square feet of floor space. Additional devices may be added without increasing the space requirements. For example, the machine may include devices, individually or in combination, to align the cover material with the spine, to combine the cover material with the spine and panels, to compress the cover material to the spine and panels, to rotate and elevate the hard cover assembly, to compress the folded edges onto the panel and spine, to tuck the corners of the cover material, and/or to stack the finished hard book cover assemblies.

In one embodiment, a compact apparatus for making hard book cover assemblies includes a cutter as well as a conveyor that centrally supports a hard book cover assembly by pressuring the assembly from the top and bottom. The edges and/or corners of the hard book cover assembly may be suspended while only the central portion of the assembly is in contact with the conveyor. One or more cutters may be positioned to receive one or more of the suspended corners. The cutter and conveyor may be moved horizontally and/or vertically in relation to each other. For instance, the conveyor may move the hard book cover assembly vertically to a horizontal plane that positions a corner of the hard book cover assembly at a height at which the cutter can cut the corner. Additional corners may be cut by rotating the book cover assembly about its vertical axis and aligning an uncut corner with the same cutter so that multiple corners on a single hard book cover assembly can be cut by the same cutter. Thus, fewer than four cutters, for example, one, two or three cutters may be used to cut all four corners of a hard book cover assembly without moving the hard book cover assembly to a different station. Cutting may also be completed without moving the position of the cutter.

In another embodiment, the apparatus can be configured so that corner cutting can be done in the same general space as other procedures, such as tucking and folding. The apparatus need not hand off the book cover assembly before or after the cutting process. The apparatus may alter the positions of a cutter, a tucking device, a folding device, or any combination of these. By supporting the hard book cover assembly in a rotatable conveyor, the assembly may be delivered to any one of the cutter, tucking device or folding device by moving the conveyor separately or in conjunction with the tucking device, folding device, or cutter. Without the need to transfer a hard book cover assembly in an arc from station to station, movement in a single horizontal direction combined with an infinitely rotatable conveyor can provide for a compact apparatus. The cutter may be positioned at a distance from a tucking device or the folding device that is less than the width or height of the hard book cover assembly. The hard cover book assembly may be moved less than one book cover width between cutting and other operations, allowing compact positioning of the cutter on the apparatus. The hard book cover assembly may not need to be moved out of one location in order to proceed with the next process step. Vertical movement capability of the cutter or conveyor may also aid in performing cutting operations within a small area. The cutter may form an integral part of the book cover making apparatus where the apparatus requires less than 200, 100, or 50 square feet in which to operate. The apparatus may be installed in spaces where installation of larger machines that require different "stations" for each operation, e.g., cutting and folding, is either not practical or not possible.

A compact apparatus for making hard book cover assemblies may provide little room for multiple operations. For instance, a hard book cover making apparatus that includes a conveyor that moves in a single horizontal direction may not be able to provide access to multiple operations, for example, folding, tucking and cutting. This typically means that one or more of these operations needs to be completed on a separate apparatus and requires transfer of an unfinished hard book cover assembly from one apparatus to another.

In another aspect, the book cover making apparatus may combine a tucking device with a cutter. For example, a tucking device (as described in the '094 patent) and a cutter may be positioned so that tucking and cutting can be performed at the same, or substantially the same, location. In this manner, the unfinished hard book cover assembly does not need to be moved to another station in order to complete an additional step. In this configuration, substantial space savings can be realized because tucking and cutting devices can occupy the same space. Furthermore, a common drive can be used to move both the tucking device and the cutter. All four corners may be cut prior to tucking. However, corners may be cut and tucked, one, two, three or four at a time. Comers may be cut two at a time and tucked two at a time.

Figure 17:
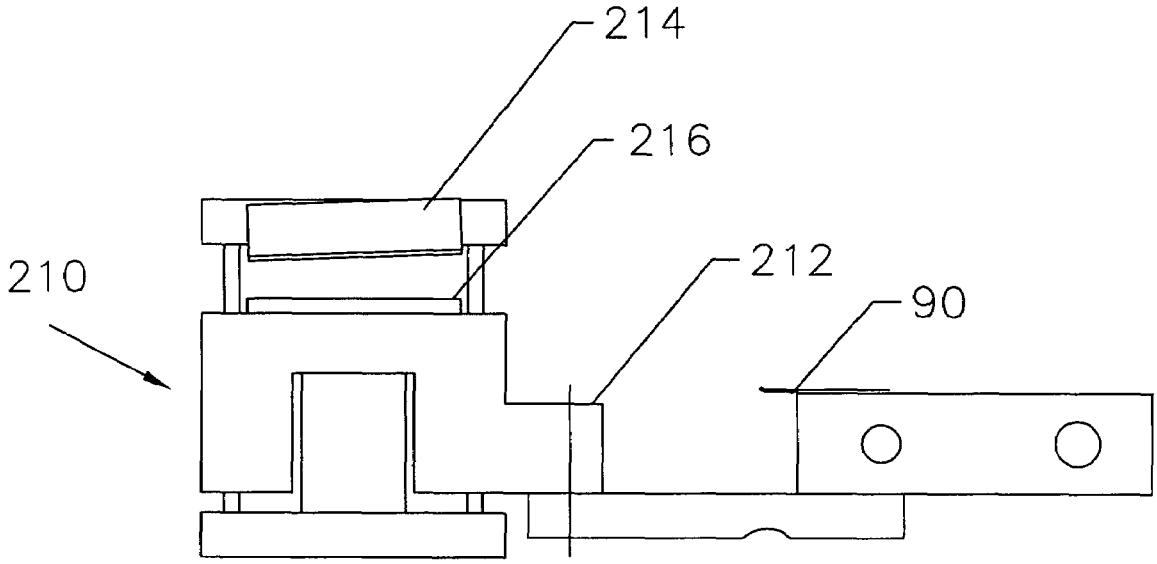
FIG. 17 is a diagrammatic elevational view of the cutter and tucking device.

In one embodiment, the apparatus includes a cutter and a tucking device that may be driven by a common motor or motors, may share a common connection to a framework, may operate on the book cover assembly at essentially the same location, may be controlled by a common controller, or any combination of these. In one embodiment, the corner cutter can be attached to the tucking device by way of a locking pin used to join the two devices, as illustrated in FIG. 17.

The cutter and tucking device each may be configured so as not to interfere with the operation of the other. In one embodiment, the cutter may be aligned at 45 degrees with respect to the tuck device (see FIG. 12). As both the cutter and the tuck device may operate on a corner of the book cover assembly, both may be operated without hindrance from the other if one of the cutter and tuck device is configured forward and outside (as viewed, for example, from the right side of FIG. 12B) of the other. If the combination cutter and tuck device can be moved toward and away from the center of the hard book cover assembly in a horizontal plane (right and left when viewing FIG. 12B from the right side) then the cutter and tuck device may obtain independent access to the corner of the hard book cover assembly by moving the assembly back and forth in a line (front to back when viewed from the right side of FIG. 12B). Thus, when the forward device (cutter in FIG. 11B) is operating on the corner, the rearward device may be back and uninvolved. Likewise, when the rearward device is operating on a corner (FIG. 15B), the forward device is outside (to the right or left) of the book cover assembly and may thus be uninvolved.

In another embodiment, the apparatus may include a cutter that is in a different horizontal plane than the tuck device, allowing each to operate on the book cover assembly independently by altering the vertical positioning of the book cover assembly in relation to the tuck device, the cutter, or both. This can be done by changing the position of the book cover assembly, changing the position of the tuck device, changing the position of the cutter, or a combination thereof. The apparatus may raise or lower the book cover assembly by, for example, raising and lowering, moving forward and back, or rotating the hard book cover assembly in order to present the corners to the cutter or to the tuck device. For example, a conveyor, such as a platen assembly, may be employed to facilitate these different movements. The conveyor may move the book cover assembly in the X direction, Z direction, and/or may allow the book cover assembly to be infinitely rotated. In some embodiments, the hard book cover assembly may not move in the horizontal Y direction. By supporting the hard book cover assembly from the top and bottom (when the book cover assembly is in a horizontal plane) in a central area of the assembly, the hard book cover assembly can be easily rotated to expose edges and corners to, for example, cutting, tucking, folding and other processes. Furthermore, this may be done without moving the book cover assembly to a different station.

In another aspect of the invention, the apparatus provides for the use of cover material that may have otherwise been unused or under utilized. Cover material that is printed, cut, or otherwise processed incorrectly (imperfect) can be saved and used to produce a hard book cover assembly that may, when complete, appear to the reader identical to a book cover produced with a perfectly printed, cut, and processed cover material.

Traditionally, the amount of cover material overhang on an unfinished book cover assembly was equal, or approximately equal, on opposing edges. For example, if 0.5 inches of material extended off the top of the assembly, about 0.5 inches would extend off the lower edge of the assembly. This was accomplished by simply centering the rigid component over the center of the cover material. Cover material was often notched to aid in aligning with a spine. If a cover material did not result in a proper finish when centrally aligned to produce a book cover, the cover material was typically disposed of, or an imperfect book cover could be produced. When edition corners were made, the corners of the cover material were cut with the expectation that the rigid component would be placed square and centered on the cover material. Consequently, identically sized pieces of material were cut from each corner.

In one embodiment, the apparatus may produce book covers with, for example, the spine and panels out of center or out of alignment with respect to the cover material. The apparatus may be used to purposefully misalign or uncenter cover material in order to compensate for imperfectly printed (for example, off-center) or cut cover material. The corners of a single book cover assembly may be cut by varying the position of the cutter in relation to the position of the spine or panels rather than by fixing the cut location to the position of the cover material. The apparatus may cut the cover material at a location different than would an apparatus that uses the cover material position as a reference point or an apparatus that simply assumes that the rigid component is centered on the cover material.

When the cover material is not centered or is skewed (out of alignment) with respect to the rigid component, the apparatus may be used to produce hard book cover assemblies that can compensate for imperfections in the cover material, for example, the printing process. This may result in, for example, less scrap and greater efficiency. The apparatus may produce an uncentered or skewed book cover assembly, for example, by affixing the cover material to the rigid component with reference to a point or line other than those provided by the outer edges of the cover material. For example, the rigid component may be aligned with reference to the printing on the cover material rather than by centering the rigid component with reference to the geometry (or a notch) of the cover material. The rigid component may be joined to the cover material so that the edges of the rigid component and the edges of the cover material are out of parallel by, for example, more than 1, 3, 5 or 10 degrees.

In instances when the cover material is oriented to the rigid component in a manner that is not geometrically centered, unequal overhang between opposing edges may result. Consequently, if the same amount of material were cut from corners having unequal overhanging cover material, the amount of material left (post cutting) that extends past the corner of the panels would vary widely, potentially leading to poor corner formation. In one embodiment of the invention, when overhang on opposing edges is not equivalent, or when an overhanging edge is not parallel to the edge of a panel, different amounts of material may be removed from one or more corners. In another embodiment, the corners may be cut a specified distance from the corner of the panel or from another point associated with the orientation of the rigid component rather than the orientation of the cover material.

The position and size of the rigid component may be determined by any suitable method, such as, for example, by locating a point or points on the rigid component, locating an edge of the rigid component, or providing instructions as to the position of rigid component. The position of the rigid component may be determined before or after the rigid component is affixed to the cover material. The position may be fed to a computer, for example, by manually inputting a size, or code defining a size, or, in another alternative, by locating the position of the edges of the panels. This may be done after the components have been laid on a surface, such as an infeed table. The position may be input or transmitted to a controller. The controller (computer) may then instruct the cutter on where to cut by, for example, orienting the cutter, the hard book cover assembly, or both. Preferably, a rotary sizing device such as that described in the '094 patent is used. This device can provide height and width dimensions to the controller and provides a way to easily change between different sized hard book cover assemblies.

In one embodiment, the position of the rigid component may be determined independently for each book cover assembly that is produced, or can be determined for one book cover assembly and maintained for additional book cover assemblies. Alignment of the rigid component and the cover material may be done manually. The position of the rigid component may be determined by, for example, locating a point or points on the spine and/or panels, or by measuring a dimension of the rigid component. The measurement may be made before or after the spine and panels are placed together with the cover material. Any appropriate measurement device may be used, including, but not limited to, video systems, a caliper, a laser, a ruler, a linear sizing device or a rotary sizing device. In one embodiment, two rotary sizing arms may be used to determine the height and width of the rigid component.

In another embodiment, the sizing device may include a thickness measuring device. For example, in addition to measuring the height or width of the rigid component, the thickness of the rigid component may also be measured. A separate caliper in communication with a controller, or one that is integral to the sizing device may be used. By supplying thickness information to the controller, cover material may be cut to provide an amount of overhang that is a function of the rigid component thickness, e.g., two times the rigid component thickness, without input from an operator. Hard book cover assemblies using rigid components of different thicknesses may be produced in succession without additional input from an operator.

In one embodiment, the spine and panels may be oriented in relation to the printing on the cover material and not in relation to the cover material sheet itself. This procedure may be done manually by the operator. For example, the cover material may be laid on a surface and specific printing that is intended to be in the middle of the spine of the finished book can be manually aligned with a mark, for example, a centerline. This may be done independently of the shape and/or size of the cover material. If the cover material is laid on the surface in a face-down (printed side down) position, a portion of the surface may include a "see-through" window. The window may include a portion of the surface over which the spine will be laid. Using this window, the printing may be visually centered, for example, by viewing from below. This can be done, for example, by using a video camera or a mirror. A center line may be a line printed on, or extending through, the window or may be a virtual line placed on the video display. By aligning the printing with a centerline or other indicia, the cover material of the unfinished hard book cover assembly may be positioned so that it overhangs one panel more than the other, is shifted up or down, or may be skewed in relation to the panels.

A location or dimension of the spine and panels may be used to direct the conveyor or the cutter to a desired location to cut the cover material. For example, the cutter may be directed to cut the cover material on a line that is 45 degrees in relation to the edge of the panel (which, in some cases, may not be in alignment with the cover material) at a point about two panel thicknesses from each outer corner of the panel assembly. This may be done, for example, by controlling the position of the cutter, the book cover assembly, or both. Thus, each of four cover material corners may be cut the same distance from its associated panel corner without regard to the amount of cover material originally extending past the panel corner.

When the cover material corners are cut, the corners may, in some cases, be cut at a 45 degree angle to the longitudinal edges of the panel with some remaining material extending outwardly past the corner of the panel in a direction following a line that bisects the 90 degree angle formed by the corner of the panel. This amount of extending material may be enough to provide some overlap of cover material when the edges are folded, but not so much that unsightly bunching occurs. Preferably, the amount of material extending past the corner of the panel is between one and three times the thickness of the panel material and often about twice the thickness of the panel material.

In one embodiment, the apparatus may vary the amount of remaining material extending past the corner of the panel for one or more book cover assemblies. For example, the operator may choose to increase or decrease the amount of remaining overhang. This may be desired, for example, if a different type of cover material or adhesive is being used. The amount of overhang may be adjusted by, for example, varying the distance of the cutter from the rigid component at the time the cutter is activated. In one embodiment, the operator may send a command to the controller that may in turn adjust the operation of the cutting procedure in order to reflect the desired overhang change.

One skilled in the art will recognize that if the cover material (uncut) is centered on the spine, with equivalent overhang on opposing edges, the same amount of material may be cut from each corner to result in four properly folded edition corners. However, if the cover material does not extend equally from opposing edges of opposed panels, or from the top and bottom of the book cover assembly, or if the cover material is skewed in relation to the panels, a different amount of material may be removed from each corner to provide four properly folded edition corners. If the same amount of material is cut from each corner of such a book cover assembly, one or more imperfect corner folds may result. Thus, different amounts of material may be cut from different corners on the same book cover assembly. Although a triangle-shaped piece of material is often cut off at a 45 degree angle, other shape cuts and other angles may also be used.

Figure 18:
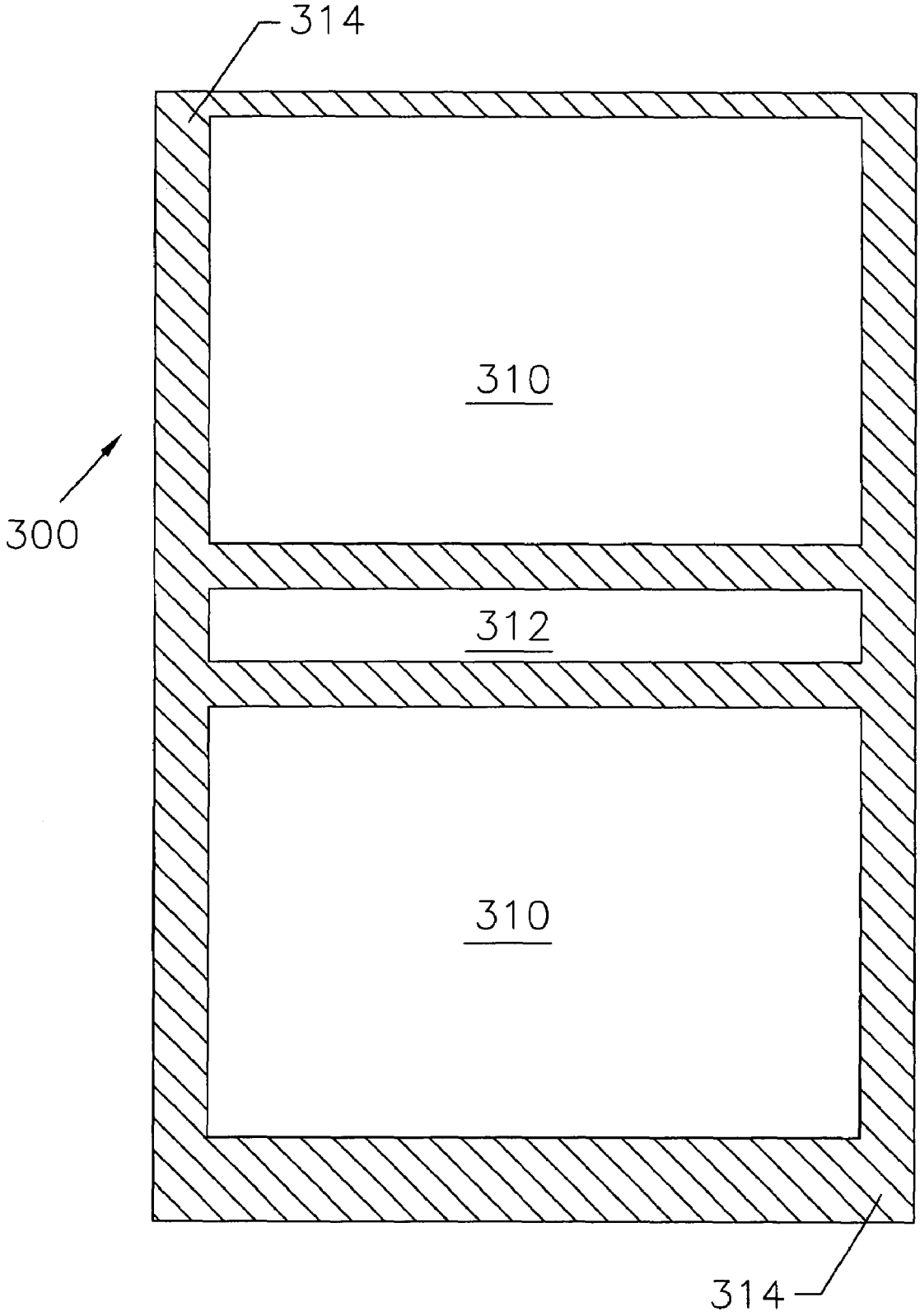
FIG. 18 illustrates a hard book cover assembly with cover material off-center.
Figure 19:
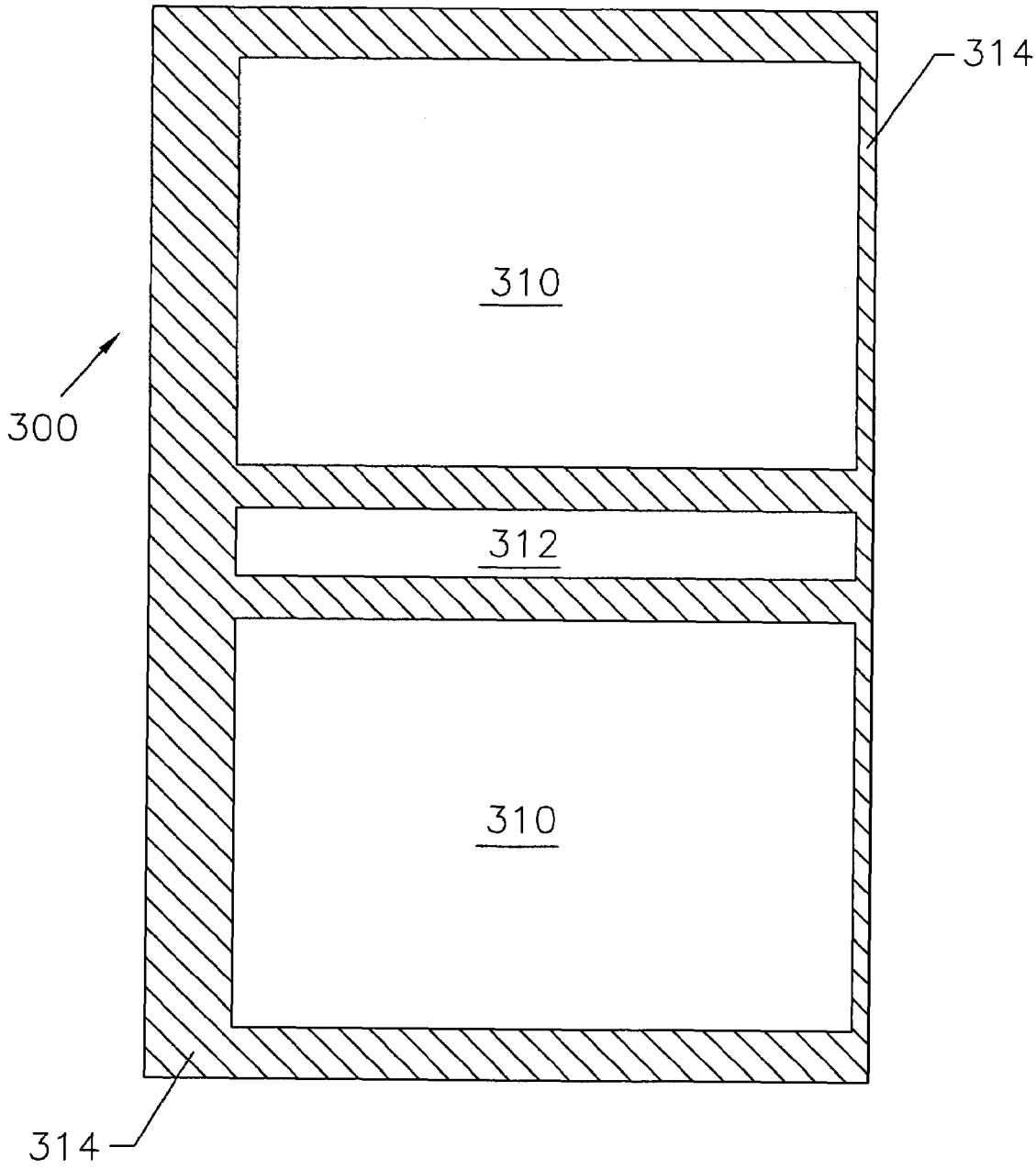
FIG. 19 illustrates a hard book cover assembly with cover material off-center.
Figure 20:
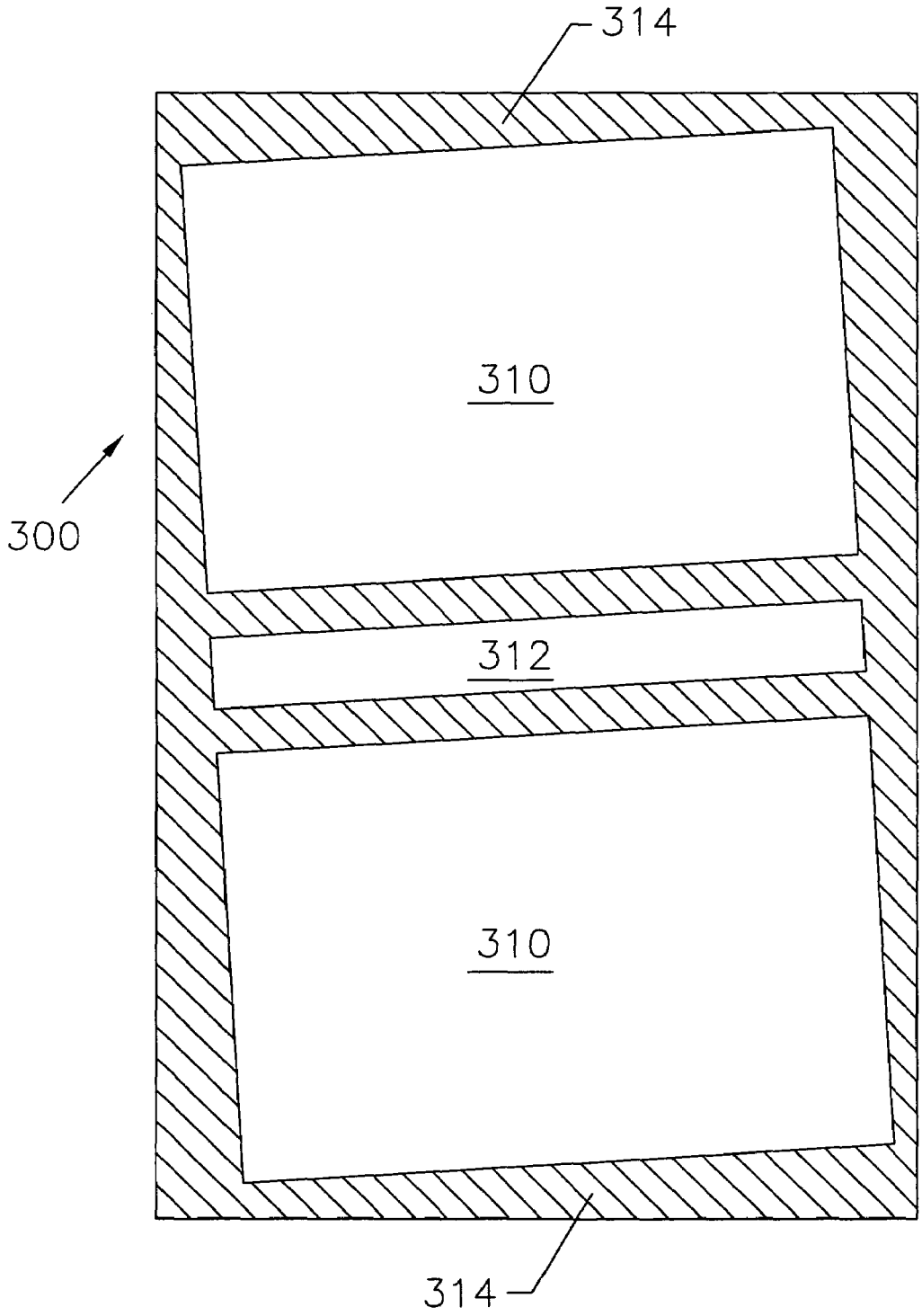
FIG. 20 illustrates a hard book cover assembly with cover material off-center and skewed.

FIGS. 18-20 illustrate the interior surface of finished hard book cover assemblies, 300, that have been made using an apparatus where the cover material has not been centered and/or squared in relation to the spine and panels, but instead has been registered by aligning printing on the cover material with a line corresponding to the center of the spine. The rigid component includes panels 310 and spine 312. Cover material 314 has been folded back and glued onto the inside edges of the rigid component. Although not shown in the figures, the corners have been tucked and portions of cover material have been folded over corners of the panels and glued.

In FIG. 18, a greater amount of folded cover material 314 is apparent on the right side of the book cover assembly when compared to the left. In FIG. 19 the cover material has been shifted downward providing for a larger amount of material being folded over at the bottom than at the top. In FIG. 20 the material has been skewed in relation to the two panels and the center spine resulting in folded edges of varying width on all four sides. Thus, in FIGS. 18 and 19 the spine and panels were placed on the cover material with edges parallel to those of the cover material but with the spine and panels off center. In FIG. 20, the spine and panels were placed on the cover material so that the edges of the panels were not parallel to the edges of the cover material. The adjustments used to make the book covers in FIGS. 18 and 19 may be desired when the printing has shifted either left or right or up or down from the desired position. The book cover shown in FIG. 20 may be desired when the printing on the cover material is misaligned in relation to the cut edges of the cover material. For any of these three configurations, the amounts of cover material cut from each corner must vary within a single hard book cover assembly if a similar amount of cover material overhang is to be left extending from each corner. If similar size triangles were cut from each corner of the cover material, these completed assemblies, as shown, would not result.

Figure 21:
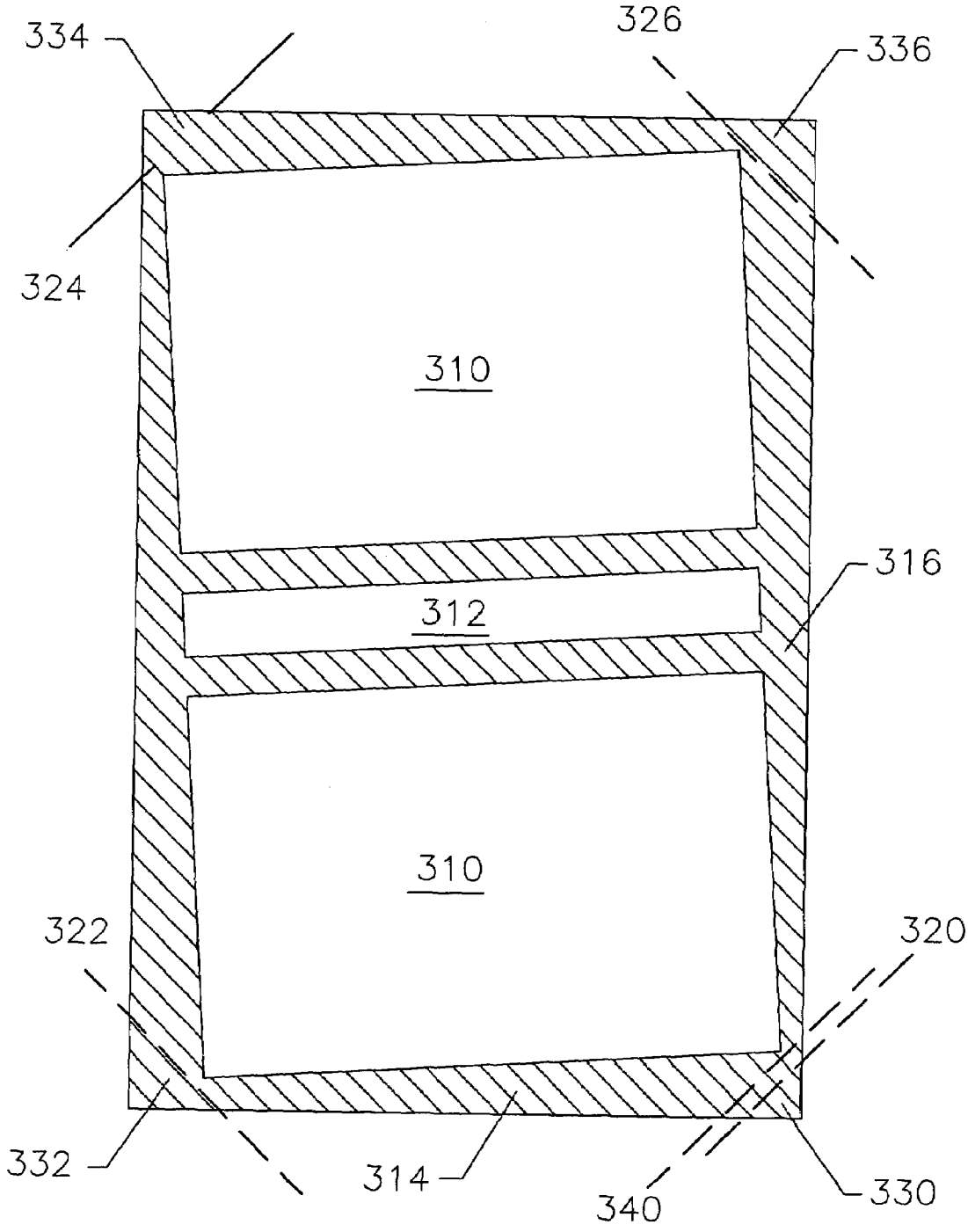
FIG. 21 illustrates a hard book cover assembly with cover material skewed and also shows appropriate cut lines.

FIG. 21 illustrates an unfinished hard book cover assembly after the rigid component has been placed on the cover material so that the edges of the rigid component are not parallel to the edges of the cover material. Such a configuration may be used when cover material has been misprinted or miscut. Completion of the assembly will result in a finished product similar to that illustrated in FIG. 20. In FIG. 21, the rigid component is made of spine 312 and panels 310. The unprinted side 316 of the cover material is shown and is covered with a layer of adhesive for adhering the cover material to the rigid component. Cut lines 320, 322, 324 and 326 illustrate the approximate location and angles where the cover material is cut to result in properly formed edition corners. The corner portions being removed by the cutting process, 330, 332, 334 and 336 are of different sizes and shapes. The amount of cover material overhang remaining after a cut is represented by the distance between lines 320 and 340.

When the finished book is being placed in the book cover, paper may be glued on the inside of the book cover. This paper may cover the edge of the cover material that has been folded onto the panels, thus obscuring from the reader that the cover material was not centered in relation to the spine and panels. Therefore, a reader will be unable to tell the difference from a cover that was printed, cut or processed incorrectly and then rectified using this cover making technique and a book made with a perfectly printed and cut cover material. Therefore, a useful hard book cover assembly may result where previously the cover material would have been disposed of.

Traditionally, edition corners have dictated that cover material corners are cut prior to applying adhesive to prevent fouling of cutting knives and because cover material is often cut in stacks of many sheets. The present invention, however, can provide for corner cutting after adhesive is applied.

After adhesive is applied to the non-printed side of the cover material, the overhanging portion of the cover material, and the corners in particular, may sag or curl due to, for example, the unequal expansion of the fibers of the cover material. When the unfinished hard cover book assembly is suspended, for example, by a conveying device, any sagging cover material may not feed properly when the corner is fed to a cutter, such as one that is composed of, for instance, an upper knife blade and a lower shear plate (see FIG. 17). The sagging corner may get caught on the lower blade when an attempt is made to insert the corner between the upper and lower knives. This may result in not only an improper cut when the upper blade is lowered (or lower blade raised) but may result in fouling of the cutter due to the deposition of adhesive on the mechanism. While useful in some embodiments, increasing the distance between the upper knife blade and shear plate may still result in poor cuts because the cover material may not be placed close enough to the stationary blade in order for a clean cut to be made.

In another aspect, the apparatus may cut portions from a hard book cover assembly when edges of the cover material may not be in a horizontal plane or may otherwise be misaligned for proper cutting. The apparatus may be constructed and arranged to position a corner of cover material in alignment with a cutter and then alter the height of the cover material in relation to the cutter, prior to cutting a corner from the cover material. This may alleviate, for example, the problem of sagging corners fouling the cutter.

In one embodiment, the corner of the cover material is fed between an upper knife blade and a shear plate that are separated by a distance that may be close to, or greater than, the maximum amount of cover material overhang to be expected for a specific hard book cover assembly. For example, if the maximum expected overhang of material is about 1 inch, then the upper knife blade and shear plate may be separated by about 1 inch. The hard cover book assembly may be fed into the cutter in a plane that is close to, but just below, the lower surface of the upper knife. The book cover assembly is then lowered, in relation to the cutter, so that the plane,of the book cover assembly is approximately on the same plane as the upper edge of the shear plate. In this manner, any sagging portion of the corner may have already been extended through the knife opening and may not foul the cutter. The corner can then be cut. In an embodiment where the stationary blade is the upper blade, then it may be preferred that the book cover assembly be fed to the cutter at a height close to the lower edge of the upper stationary blade.

In some cases, for example when a corner of the cover material has curled back under the corner of a panel, it may be preferable to also horizontally move the corner of the hard cover book assembly past the cutting edge of the knives and then to draw back the corner to the cutting position after the hard book cover assembly has been positioned close to the upper surface of the lower knife. This may effectively uncurl a badly curled corner so that a straight, properly positioned cut can be made and may also help reduce transfer of adhesive to the cutter. This may help reduce scrap rates as well as prevent fouling of the cutter.

In another aspect, the apparatus may be quickly changed over for producing different sized or shaped covers. The process may include cutting corners from the cover material of each of the different sized book cover assemblies.

Traditionally, setting up a machine for a different sized book cover can be a time intensive process, particularly when corner cutting must done on book cover assemblies of different sizes. This changeover time can become very costly when a machine is to be used for short or very short runs of book covers, making the changeover time a significant portion of the total time of operation. In some cases, the changeover time may exceed the actual production time.

In one embodiment, the apparatus of the present invention can provide for the changeover to a new size book cover and the production of the book cover in less than 2 minutes, 90 seconds, 60 seconds, 30 seconds or even 20 seconds. One technique to facilitate a fast changeover is by measuring the dimensions of the panels and spine material after they are laid out and using this measurement to direct the cutters where to cut. This may be accomplished by the combination of a sizing device and a cutter that may each communicate with a common controller. The set up, loading, and transmission of sizing information to a controller may be completed in less than the cycle time of a similarly or dissimilarly sized book cover assembly (less than or equal to about 16 seconds) and may be done while a preceding hard book cover assembly is being processed. The sizing device may transmit a signal to the controller that includes at least a portion of a dimension of the hard book cover assembly. Thus, in this embodiment, no additional time needs to be allocated for set-up when switching between book cover sizes. The required production time for two dissimilarly sized hard book cover assemblies may be the same as for two identically sized hard book cover assemblies.

In another aspect, an apparatus and a method are provided for cutting a corner from cover material while rotating the hard book cover assembly. In one embodiment, a cutter, such as a single knife edge, is placed in the path of the cover material as the cover material is rotating. In one embodiment, the plane in which the hard book cover assembly is rotated is the same as the plane in which the unfinished hard book cover assembly is held. The axis of rotation may be the center of the rigid component (that will become the center of the finished hard book cover assembly) and, for example, by placing the cutter at a certain distance from the center of the hard book cover assembly, two, three or four corners of the unfinished hard book cover assembly can be cut at the same radius from the center of the rotating hard book cover assembly. This distance (the radius of cutting) may be supplied by a controller. The controller may use input from, for example, onboard or external memory, operator input or a sizing device such as a pair of rotary sizing devices. Operator input methods may include a keyboard or a touch screen display. The cutter may remain stationary and any movement and/or shear force required for cutting can be supplied by the rotating hard book cover assembly. Adhesion of cut off corner pieces to the cutter may be minimized, and if adhesion does occur, additional corners may be cut without interference from previously cut corner pieces.

Figure 22:
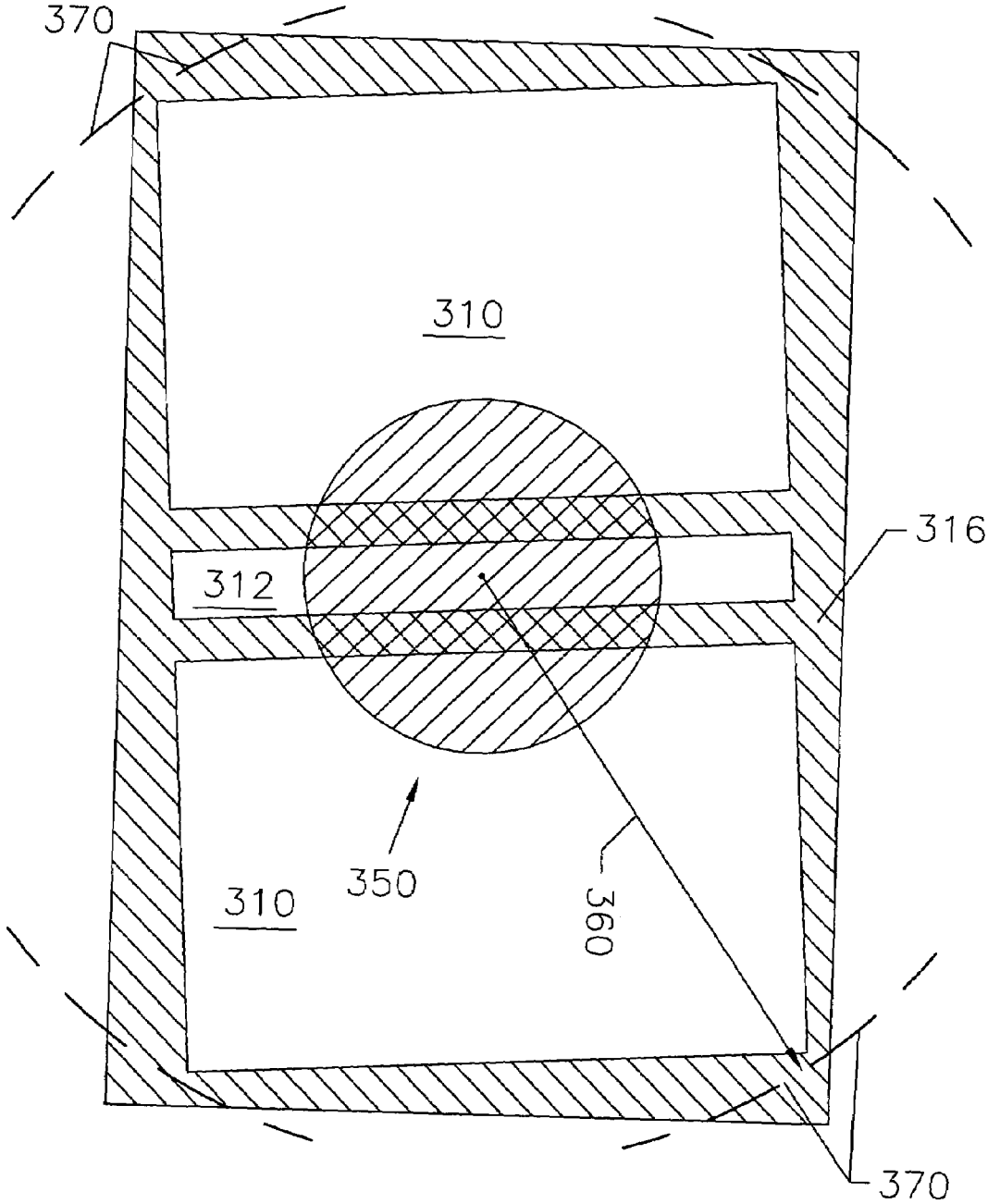
FIG. 22 illustrates a hard book cover assembly providing positioning of a conveyor and a radius and arc for cutting material from the assembly while the assembly is being rotated.

FIG. 22 illustrates how an unfinished hard book cover assembly can be rotationally cut. A hard book cover assembly is shown including 2 panels 310, a spine 312 and cover material 316. Circular platen assembly 350 secures the hard book cover assembly from the top and the bottom and is centered on the rigid component. As the assembly is rotated, a cutter is placed in position to cut the cover material in an arc 370 that is a radius 360 away from the center of the assembly. The cutter may be stationary while the assembly is rotating. In this illustration, approximately the same amount of cover material overhang may remain from each cut corner as the cutting distance from the center of the rigid component can be the same for each corner.

In one embodiment, the speed of rotation may be varied with, for example, the type of cover material, the type of cutter and the size of the hard book cover assembly. For instance, a larger hard book cover assembly may be rotated at a slower angular velocity as the greater radius will provide for faster speed at the point of impact with the cutter. Preferred rotational speeds for specific cover materials can be determined by routine experimentation at different speeds.

In another embodiment, it is preferred that the cutter or cutters are capable of removing a corner in a single pass and that the cutter or cutters can remove multiple corners while remaining stationary. In instances where a knife edge, wire, or similar solid surface is the cutter, the cutter may be positioned perpendicular to the path of rotation or at a slight slant away from perpendicular to facilitate clean cutting through the cover material. To place the cutter in position to cut at the desired radius, e.g., positioned to leave about two panel thicknesses of overhang from each corner, the cutter can be moved into position while the hard book cover assembly is rotating. Alternatively, the cutter can be moved into position prior to rotating the assembly.

In another embodiment, the cutter may also be a device that can be placed at the cutting location without interfering with the rotating hard book cover assembly. For example, the cutter may be moved into alignment with the cutting location of the corners of the cover material of the assembly before, or while, the assembly is rotating. When the cutter is aligned and the assembly is rotating at a cutting speed, the cutting element of the cutter may be activated to cut corners from the cover material. This class of cutters, herein "switchable cutters," includes, for example, lasers, water jets and other cutters in which the cutting element can be turned on and off. Preferably, the cutting element, e.g., the laser beam or the water jet stream, is positioned perpendicular to the direction of rotation of the hard book cover assembly. Switchable cutters may provide for faster operation and may reduce or eliminate surfaces on which cut off corners may attach to and cause fouling.

Rotational cutting may provide cut corners that are cut on an arc. When cutting corners from smaller cover assemblies, a more exaggerated arc may form. The apparatus may be constructed and arranged to cut corners in any shape, such as, straight lines or reverse arcs, for example, by altering the distance between the cutter and the center of the hard book cover assembly while a corner is being cut. In one embodiment, the position of the cutter can be altered during cutting to change the shape of the cut. In another embodiment, the position of the centerline of the hard book cover assembly can be altered during the cutting process to change the shape of the cut. This may be done by moving the conveyor during the cutting process. In yet another embodiment, both the position of the cutter and the position of a centerline of the hard book cover assembly can be altered to change the shape of the cut.

For example, a cutter may be constructed and arranged to move inward toward the center of the hard book cover assembly as a corner is being cut. After reaching about the midpoint of the cut, the cutter can be moved in the outward direction so that at the end of the cut the cutter is positioned the same distance from the center of the hard book cover assembly as when the cut was started. In addition to, or as an alternative to, moving the cutter while cutting, the hard book cover assembly may be moved while a corner is being cut to produce similar or identical results. For example, the conveyor may be moved backward or forward, or both, in the x direction (as shown in FIG. 1A) while a corner is being cut in order to alter the shape of the cut. In some instances, the cutter may be stationary while the cuts are made. The corners of the cover material may be cut so that the amount of remaining cover material overhanging the corner in a direction that bisects the 90 degree corner of the adjacent panel is an amount sufficient for folding back onto the interior side of the panel. This overhang amount may be, for example, from one to three times the thickness of the panel, or, preferably, about two times the thickness of the panel.

In one embodiment, the cutter may be associated with a framework that also supports additional parts of the apparatus. The cutter or cutters may be mounted as are other cutters described herein. For example, the cutter or cutters may be mounted to a tucking device or may be mounted directly to a framework. The cutter may be mounted on an independent axis. A rotational cutting technique may provide additional mounting options as a single cutter may cut multiple corners on the same hard book cover assembly. Furthermore, a switchable cutter may be mounted at locations where other types of cutters might interfere with movement and operation of the unfinished hard book cover assembly. The cutter may be in communication with a controller. The controller may also be in communication with other devices, for example, any one or more of a folding mechanism, a tucking device, a compression mechanism, a sizing device and a conveyor.

A controller may be, for example, a microprocessor or computer, as described in the '094 patent. A controller may include several known components and circuitry, including a processing unit (i.e., processor), a memory system, input and output devices and interfaces (e.g., an interconnection mechanism), as well as other components, such as transport circuitry (e.g., one or more busses), a video and audio data input/output (I/O) subsystem, special-purpose hardware, as well as other components and circuitry, as described below in more detail. Further, the controller may be a multi-processor computer system or may include multiple computers connected over a computer network.

The controller may include a processor, for example, a commercially available processor such as one of the series x86, Celeron and Pentium processors, available from Intel, similar devices from AMD and Cyrix, the 680X0 series microprocessors available from Motorola, and the PowerPC microprocessor from IBM. Many other processors are available, and the computer system is not limited to a particular processor.

A processor typically executes a program called an operating system, of which WindowsNT, Windows95 or 98, UNIX, Linux, DOS, VMS, MacOS and OS8 are examples, which controls the execution of other computer programs and provides scheduling, debugging, input/output control, accounting, compilation, storage assignment, data management and memory management, communication control and related services. The processor and operating system together define a computer platform for which application programs in high-level programming languages are written. The controller used herein is not limited to a particular computer platform.

The controller may include a memory system, which typically includes a computer readable and writeable non-volatile recording medium, of which a magnetic disk, optical disk, a flash memory and tape are examples. Such a recording medium may be removable, for example, a floppy disk, read/write CD or memory stick, or may be permanent, for example, a hard drive.

Such a recording medium stores signals, typically in binary form (i.e., a form interpreted as a sequence of one and zeros). A disk (e.g., magnetic or optical) has a number of tracks, on which such signals may be stored, typically in. binary form, i.e., a form interpreted as a sequence of ones and zeros. Such signals may define a software program, e.g., an application program, to be executed by the microprocessor, or information to be processed by the application program.

The memory system of the controller also may include an integrated circuit memory element, which typically is a volatile, random access memory such as a dynamic random access memory (DRAM) or static memory (SRAM). Typically, in operation, the processor causes programs and data to be read from the non-volatile recording medium into the integrated circuit memory element, which typically allows for faster access to the program instructions and data by the processor than does the non-volatile recording medium.

The processor generally manipulates the data within the integrated circuit memory element in accordance with the program instructions and then copies the manipulated data to the non-volatile recording medium after processing is completed. A variety of mechanisms are known for managing data movement between the non-volatile recording medium and the integrated circuit memory element, and the controller that implements the methods, steps, systems and system elements described herein and is not limited thereto. The controller is not limited to a particular memory system.

At least part of such a memory system described above may be used to store one or more data structures (e.g., look-up tables) or equations. For example, at least part of the non-volatile recording medium may store at least part of a database that includes one or more of such data structures. Such a database may be any of a variety of types of databases, for example, a file system including one or more flat-file data structures where data is organized into data units separated by delimiters, a relational database where data is organized into data units stored in tables, an object-oriented database where data is organized into data units stored as objects, another type of database, or any combination thereof.

The controller may include a video and audio data I/O subsystem. An audio portion of the subsystem may include an analog-to-digital (A/D) converter, which receives analog audio information and converts it to digital information. The digital information may be compressed using known compression systems for storage on the hard disk to use at another time. A typical video portion of the I/O subsystem may include a video image compressor/decompressor of which many are known in the art. Such compressor/decompressors convert analog video information into compressed digital information, and vice-versa. The compressed digital information may be stored on hard disk for use at a later time.

The controller may include one or more output devices. Example output devices include a cathode ray tube (CRT) display 603, liquid crystal displays (LCD), touch screen display and other video output devices, printers, communication devices such as a modem or network interface, storage devices such as disk or tape, and audio output devices such as a speaker.

The controller also may include one or more input devices. Example input devices include a keyboard, keypad, track ball, mouse, pen and tablet, touch screen, communication devices such as described above, and data input devices such as audio and video capture devices and sensors. The controller is not limited to the particular input or output devices described herein.

The controller may include specially programmed, special purpose hardware, for example, an application-specific integrated circuit (ASIC). Such special-purpose hardware may be configured to implement one or more of the methods, steps, simulations, algorithms, systems, and system elements described above.

The controller and components thereof may be programmable using any of a variety of one or more suitable computer programming languages. Such languages may include procedural programming languages, for example, C, Pascal, FORTRAN and BASIC, object-oriented languages, for example, C++, Java and Eiffel and other languages, such as a scripting language or even assembly language.

The methods, steps, simulations, algorithms, systems, and system elements may be implemented using any of a variety of suitable programming languages, including procedural programming languages, object-oriented programming languages, other languages and combinations thereof, which may be executed by such a computer system. Such methods, steps, simulations, algorithms, systems, and system elements can be implemented as separate modules of a computer program, or can be implemented individually as separate computer programs. Such modules and programs can be executed on separate computers.

The methods, steps, simulations, algorithms, systems, and system elements described above may be implemented in software, hardware or firmware, or any combination of the three, as part of the controller described above or as an independent component.

Such methods, steps, simulations, algorithms, systems, and system elements, either individually or in combination, may be implemented as a computer program product tangibly embodied as computer-readable signals on a computer-readable medium, for example, a non-volatile recording medium, an integrated circuit memory element, or a combination thereof. For each such method, step, simulation, algorithm, system, or system element, such a computer program product may comprise computer-readable signals tangibly embodied on the computer-readable medium that define instructions, for example, as part of one or more programs, that, as a result of being executed by a computer, instruct the computer to perform the method, step, simulation, algorithm, system, or system element.

An example of how a hard book cover making apparatus including a cutter can make a hard book cover assembly is described below. This example is illustrative of one embodiment only and should not be used to limit the scope of the claimed invention.

FIGS. 1A and 1B provide side view and top view, respectively, of one embodiment of the invention. As viewed in FIGS. 1A and 1B, the unfinished hard book cover assembly is passed from left to right during the production process. The apparatus may include an infeed table 22 on which cover material (preferably with adhesive applied to the side facing up) is placed. The cover material may include a window 223 allowing light to pass through a portion of the infeed table 22. Using, for example, a mirror or video system mounted underneath the feed table, printing on the cover material can be viewed from below the infeed table. This can allow an operator to manually align printing on a portion, for example, the central portion, of the cover material with a line or other mark on the window 223. The surface of infeed table 22 may include vacuum ports for securing the cover material in position on the infeed table. Gage blocks 24 may be lowered, providing a stop for positioning a spine 240 and two panels 230.

After the spine 240 and panels 230 are placed on the adhesive coated cover material, a sizing device can be used to determine the size and/or location of the rigid component (panels and spine) of the hard book cover assembly. In the embodiment depicted in FIGS 1A and 1B, rotary sizing arms 48 and 49 are used to measure the height and width of the rigid component. Rotary sizing arms 48 and 49 are pivoted around their ends 225 and 226 until the opposite ends 227 and 228 contact the lower edge of one panel 230 (sizing arm 49) and the outer edge of the other panel 230. The amount of rotation of each sizing arm may then be transmitted to a controller (not shown) providing length and width data to the controller that may then be used later in the assembly operation. The sizing arms may be joined to rotary encoders, such as incremental or absolute rotary encoders, to convert the rotation to an electronic signal. The controller may also communicate with an operator input device such as a computer screen or a touch screen display. In one embodiment, a model CTC-P1H Mono touch screen from Parker Hannifin Corporation is used as an input device for an operator and to communicate with the operator about the condition of the apparatus. Drive table motor 40 may be activated either manually or automatically to advance the assembly through pressure rollers 21 to aid in adhering the cover material to the rigid component of the hard book cover assembly. Pressure rollers 21 may be directed by the controller to advance the unfinished book cover assembly to a point, determined by the size of the rigid component, where the assembly can be secured by conveyor 28 in a manner that allows the rigid component of the assembly to be held centered in relation to the conveyor. In the illustrated embodiment, the conveyor is a platen assembly (herein platen) that includes an upper platen assembly 52 and lower platen assembly 54. The upper platen assembly 52 and the lower platen assembly 54 can be moved vertically to sandwich the hard book cover assembly between the two. The platen may be sized so as to secure the hard book cover assembly only inside the periphery of the rigid component, thus providing access to the outer portions of the assembly for later operations.

The conveyor 28 may be constructed to move the hard book cover assembly in the x direction toward the cutters 210. By activating servo motor 100, lead screw 94 can be rotated, moving the cutters 210 in the y direction. Lead screw 94 may be oppositely threaded at opposed ends so that a common motor can bring two cutters together or move them apart. The controller, in this illustrative embodiment a Galil DMC 2183, instructs the servo motor to position the cutters 210 in a position for cutting corners from overhanging cover material of the hard book cover assembly. Information sent from the rotary sizing arms to the controller can be used for positioning the cutters 210. In the illustrated embodiment of FIGS. 1A and 1B, two cutters 210 are used to simultaneously cut two corners. The cutters 210 include an upper knife 214 and a shear plate 216. The upper knife may be actuated pneumatically and the cutting stroke may be initiated at the command of a controller. After the corners have been cut from the cover material, the upper knife may be returned to its starting position.

In the embodiment illustrated, after two corners of the hard book cover assembly have been cut, conveyor 28 can be withdrawn in the x direction to provide room for rotating the hard book cover assembly. The assembly may then be rotated 180 degrees by rotating the conveyor, and the assembly may be re-advanced in the x direction to provide access to the two remaining corners by the cutters 210.

Preferably, all four corners are cut before the edges are folded over onto the rigid component. After cutting, the remaining straight edges running between the cut corners may be folded over and adhered to the rigid component. An optional tucking step may be used during the folding process. Folding and tucking procedures are described in detail in the '094 patent which has been incorporated by reference herein.

A hard book cover assembly manufacturing process using an apparatus for hard book cover manufacture is described below using sequential figures to aid in illustrating successive steps for this embodiment.

FIG. 1A provides a side view and FIG. 1B a top view of one illustrative embodiment of a hard book cover making apparatus. The apparatus includes a pair of cutters 210 attached to a framework. In other embodiments different numbers of cutters may be used, for example, 1 or 3. Each cutter 210 includes a vertically movable upper knife 214 and a stationary shear plate 216. The knife is actuated pneumatically and is operated by a controller. As illustrated, the cutter may be attached to a tucking device 90, in this case, by a pin 212. A lead screw 94 driven by a motor 100 is capable of moving the cutter laterally. Of course, other drive mechanisms may be used as would be apparent to one skilled in the art. Rigid panels 230 and spine material 240, both of which may be made of, for example, chipboard, are also provided. Cover material 220 is provided and includes an adhesive that has been applied to the upper surface.

Figure 2A:
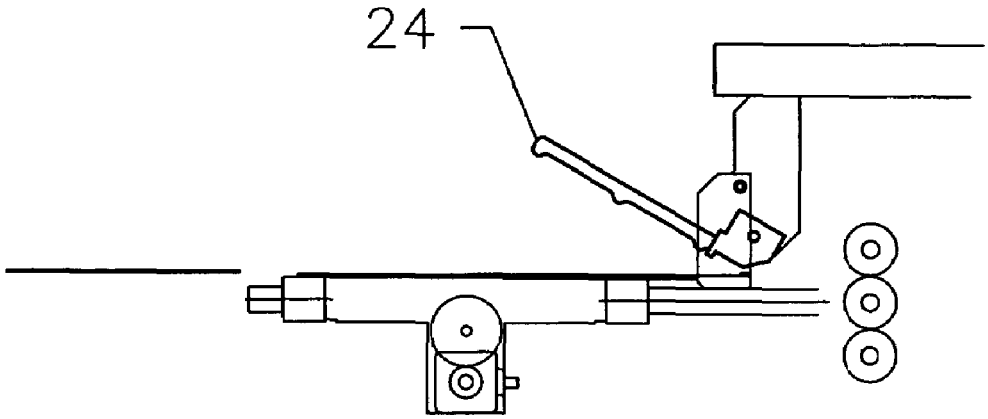
FIG. 2A is a diagrammatic partial view of the infeed table assembly with the cover material on the infeed table.

The next step of the process is illustrated in FIG. 2 where the cover material 220, coated with a layer of adhesive, is placed on a surface such as infeed table 22. The cover material is pushed up against a stop or visually registered to position it for accurate joining with the panels and spine. The gage blocks 24 are elevated (FIG. 2A) to allow placement of the cover material and then lowered to provide proper spacing for the panels.

FIG. 3A and FIG. 3B illustrate an unfinished hard book cover assembly 16 that is made by placing panels 230 and spine 240 on the adhesive covered cover material, with the panels 230 and spine 240 separated by lowered gage blocks 24.

In FIG. 4, sizing arms 48 and 49 have been rotated to contact the edges of opposed panels 230. The sizing arms are rotated to contact the rigid panel material and not the cover material. The radial position of these arms is transmitted to a computer which converts the angular position of each of the sizing arms to a height (from sizing arm 49) and the width (from sizing arm 48) of the rigid component, which but for the thickness added at the edges by the cover material, will be about the same as the dimensions of the finished cover. Of course, other suitable measuring devices may be used to provide this information to the controller, as would be apparent to one skilled in the art.

In FIGS. 5A and 5B, an automated sequence is initiated and the unfinished book cover assembly is compressed to affix the cover material to the spine and panels. As illustrated, hard book cover assembly is fed between a pair of opposing compression rollers 21 and 23.

FIGS. 6A and 6B illustrate the hard book cover assembly after it has passed through the compression rollers and has been secured by a conveyor, in this case a platen assembly which includes an upper platen 60 and a lower platen 54. The platen assembly allows the book cover assembly to be moved in the X direction, Z direction, and allows it to infinitely rotate around the vertical centerline of the book cover assembly. After being secured by the conveyor, the hard book cover assembly 16 is ready to be advanced to the cutters 210. As shown in FIG. 6, platen assembly 60 moves to the right while cutters 210 move simultaneously inward toward each other in the y direction.

FIGS. 7A and 7B show the hard book cover assembly advanced into the cutters so that a desirable amount of the corner may be cut from the cover material. As illustrated, corner portions 250 and 252 (outside of the knife edges) will be removed from the covered material upon activation of the knives. These corner portions need not be the same size.

FIGS. 8A and 8B illustrate the appearance of the hard book cover assembly immediately after the knives have cut off a portion from each corner of the cover material that has been inserted into the cutter.

In FIGS. 9A and 9B, the hard book cover assembly 16 has been withdrawn from the cutters and has been rotated 180 degrees by the platen and is now ready to be advanced to the cutters again for the trimming of the two remaining corners.

FIGS. 10A and 10B illustrate the two remaining corners, 254 and 256, in position to be cut in a manner similar to the two previously cut corners.

FIGS. 11A and 11B show the hard book cover assembly 16 immediately after the knife blade has been advanced to remove the corner material from the second two corners.

FIGS. 12A and 12B illustrate that the cutter assembly can be moved horizontally outside the width of the hard book cover assembly 16 by activating a servo motor 100, which turns lead screw 94. The same mechanism may be used to align a tuck device 90 for tucking the edge of the cover material against the edge of the panel. When the tuck fingers are aligned with the corners of the hard book cover assembly, the cutters are positioned outside and above the hard book cover assembly. Although not shown, a single servo motor can be used to move a pair of cutters. The single motor drives a single lead screw that is oppositely threaded on one side of the centerline in order to drive both cutters outwardly when the lead screw is rotated in one direction. Likewise, in this alternative case, the cutters and tuck devices would move inwardly when the lead screw is rotated in the opposite direction.

FIGS. 13A and 13B illustrate a hard book cover assembly being advanced toward a brush bar 70 which can be rotated clockwise (13A) to push the leading edge 260 of the cover material upwardly.

FIGS. 14A and 14B show leading edge 260 having been pushed in an upward direction.

FIGS. 15A and 15B illustrate the leading edge 260 being folded back onto the panels and spine. Tuck fingers 90 are positioned to tuck excess material of the folded cover material around the corner of the panels. A cam 86 is in a preliminary position so as not to apply pressure to the clamping pad 75.

FIG. 16 illustrates the cam 86 positioned to apply pressure to clamping pad 75, thus compressing the edge of the cover material, including adhesive, onto the upwardly facing side of the panels and spine, completing the folding of edge 260. This same procedure is repeated on the opposite edge by rotating the assembly.

FIG. 17 illustrates one embodiment of a cutter. Cutter 210 may be made of a durable and machinable material such as hardened tool steel and includes an upper knife 214 and a shear plate 216. The cutter may be associated with a framework in any suitable manner, including an independent axis or through another device that is associated with a framework. A pin 212 connects the cutter to the tuck device and a tuck finger 90 is also attached to the tuck device. As illustrated, the cutter 210 is attached to the tuck device at an angle of about 45 degrees (FIG. 1B), although any angle may be used. At a 45 degree angle of attachment, the cutter 210 can cut cover material corners at 45 degrees while the tuck fingers remain substantially parallel with the edges of the panels. When pin 212 is removed, the cutter can be separated from the tuck device assembly.

Upper knife 214 is slidably movable in a vertical direction and is pneumatically actuated, although alternative methods of actuation will be readily apparent to those skilled in the art. When upper knife 214 is fully raised, the distance between the upper knife and shear plate is about equal to the length of the expected overhang of cover material that is to be cut from a corner, in this case, about 1.0 inch.

The cutter 210 may be directed by a controller, such as a Galil model DMC 2183, available from Galil, Rocklin, Calif. The same controller may be used to communicate with other components of the apparatus and to coordinate other operations. Connection to various actuators and programming of the controller may be readily performed by those skilled in the art.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An apparatus for making a hard book cover assembly, the apparatus comprising:

a framework;

a sizing device associated with the framework, the sizing device constructed and arranged to determine the size of at least a portion of a rigid component of an unfinished hard book cover assembly;

a folding mechanism associated with the framework, the folding mechanism constructed and arranged to fold back a portion of cover material onto the rigid component of the unfinished hard book cover assembly; and at least one cutter associated with the framework, the at least one cutter constructed and arranged to cut at least one corner from the cover material at a position based on the determined size of the at least a portion of the rigid component.

2. The apparatus of claim 1 further comprising a controller in communication with the sizing device, the folding mechanism and the cutter.

3. The apparatus of claim 2 wherein the controller is capable of receiving position information from the sizing device and transmitting cut position instructions to the cutter.

4. The apparatus of claim 1 wherein the sizing device is a rotary sizing device.

5. The apparatus of claim 1 further comprising a tucking device constructed and arranged to tuck corners of cover material.

6. The apparatus of claim 5 further comprising a common motor to drive both the tucking device and the cutter.

7. The apparatus of claim 1 comprising a conveyor configured and arranged to secure an unfinished hard book cover assembly.

8. The apparatus of claim 7 wherein the conveyor includes a platen constructed and arranged to transport an unfinished book cover assembly to the folding mechanism and to the cutter.

9. The apparatus of claim 8 wherein the platen is configured to rotate the unfinished book cover assembly about an axis.

10. The apparatus of claim 1 wherein the framework has a footprint and the footprint is less than about 100 square feet.

11. The apparatus of claim 1 wherein the framework has a footprint and the footprint is less than about 50 square feet.

12. The apparatus of claim 1 wherein the cutter comprises an upper knife blade and a shear plate and wherein the cutter is constructed and arranged to provide an opening between the upper knife blade and the shear plate of greater than one inch.

13. The apparatus of claim 12 wherein the cutter is constructed and arranged to cut one or more corners from a cover material at a location based on the size of the at least a portion of the rigid component.

14. The apparatus of claim 1 wherein the at least one cutter is constructed and arranged to cut one or more corners from a cover material of a hard book cover assembly while the hard book cover assembly is rotated about a vertical axis.

15. The apparatus of claim 1 further comprising an infeed table for receiving both a cover material including an adhesive and a rigid component.

16. A method for producing a hard book cover assembly, the method comprising:

(a) providing an unfinished hard book cover assembly;

(b) determining a dimension of a rigid component of the unfinished hard book cover assembly;

(c) transmitting a signal comprising at least a portion of the dimension to a controller; and (d) cutting a first portion off of a cover material at a cutting location that is a function of the dimension.

17. The method of claim 16 further comprising (e) rotating the hard book cover assembly concurrently with step (d).

18. The method of claim 16 comprising adhering a cover material to a rigid component prior to determining the dimension of the rigid component.

19. The method of claim 16 wherein the dimension of the rigid component comprises the radius from the center of the rigid component to a corner of the rigid component.

20. The method of claim 16 wherein the dimension of the rigid component is the width or height of the rigid component.

21. The method of claim 16 wherein the height and width of the rigid component are determined.

22. The method of claim 16 comprising cutting at least two unequal corner pieces at positions determined as a function of the dimension.

23. The method of claim 16 wherein each corner of the cover material is cut a specified distance from the corner of a panel.

24. The method of claim 16 wherein the rigid component is out of center with respect to the cover material.

25. The method of claim 16 wherein the steps are repeated and the dimension of the rigid component is determined independently for each book cover assembly that is produced.

26. The method of claim 16 wherein four corners are cut from the cover material and each corner is cut at a point based on the same distance from the center of the rigid component.

* * * * *